US011437214B2

(12) United States Patent
Kimura et al.

(10) Patent No.: US 11,437,214 B2
(45) Date of Patent: Sep. 6, 2022

(54) ELECTRON GUN AND MANUFACTURING METHOD THEREFOR

(71) Applicant: New Japan Radio Co., Ltd., Tokyo (JP)

(72) Inventors: Toru Kimura, Fujimino (JP); Misao Iseki, Fujimino (JP); Hideyuki Obata, Fujimino (JP)

(73) Assignee: New Japan Radio Co., Ltd., Tokyo (JP)

( * ) Notice: Subject to any disclaimer, the term of this patent is extended or adjusted under 35 U.S.C. 154(b) by 0 days.

(21) Appl. No.: 17/078,598

(22) Filed: Oct. 23, 2020

(65) Prior Publication Data

US 2021/0125805 A1 Apr. 29, 2021

(30) Foreign Application Priority Data

Oct. 28, 2019 (JP) ..... JP2019-194912

(51) Int. Cl.

| | |
|---|---|
| ***H01J 29/48*** | (2006.01) |
| ***H01J 29/04*** | (2006.01) |
| ***H01J 29/62*** | (2006.01) |
| ***H01J 9/04*** | (2006.01) |

(52) U.S. Cl.

CPC ..... *H01J 29/484* (2013.01); *H01J 9/04* (2013.01); *H01J 29/04* (2013.01); *H01J 29/62* (2013.01)

(58) Field of Classification Search

None

See application file for complete search history.

(56) References Cited

U.S. PATENT DOCUMENTS 4,091,311 A 5/1978 Mendelsohn et al.
4,227,116 A * 10/1980 Miram ..... H01J 1/46 313/295

FOREIGN PATENT DOCUMENTS

CN 202633200 U 12/2012
WO 2016/029065 2/2016

* cited by examiner

*Primary Examiner* — Ashok Patel
(74) *Attorney, Agent, or Firm* — Christopher M. Scherer; DeWitt LLP

(57) ABSTRACT

An electron gun comprising a cathode having an electron emitting surface and whose planar shape is circular, a heater to increase the temperature of the cathode, and an anode to apply a positive electric potential relative to the cathode to extract electrons in a predetermined direction is provided. The cathode comprises a through hole at a central portion thereof along a central axis of the cathode, and either the cathode comprises a no-emitting layer at at least one of an opening edge on the electron emitting surface side of the through hole and an inner surface of the through hole, or the opening edge on the electron emitting surface side of the through hole is a chamfered C surface or a chamfered R surface.

10 Claims, 17 Drawing Sheets

Prior Art

Prior Art

ELECTRON GUN AND MANUFACTURING METHOD THEREFOR

CROSS-REFERENCE TO RELATED APPLICATIONS

The present application claims priority to Japanese Patent Application No. 2019-194912, filed Oct. 28, 2019, the content of which are incorporated herein by reference in its entirety.

TECHNICAL FIELD

The present disclosure relates to an electron gun, and particularly relates to an electron gun to supply electrons to operate an electron beam generating apparatus, Linac (a linear accelerator), TWT (a traveling wave tube), and Klystron and to a manufacturing method for the electron gun.

BACKGROUND OF THE INVENTION

In an electron beam generating apparatus, Linac, TWT, and Klystron as applications for using electron beams, as shown in FIG. 18, an electron gun 101 to emit thermions by using a heater 105 to heat a cathode 102 in which a thermionic emission substance is splayed onto, coated onto, or impregnated into a metal base body is provided. The related-art electron gun 101 emits electrons in a predetermined orientation and, moreover, to focus the electron beams, it is used by applying, to an anode 103 and a wehnelt 104, a positive electric potential relative to the cathode 102. In addition to the diode configuration shown in FIG. 18, as shown in FIG. 19, a method can also be provided for controlling the electron flow rate by applying a positive control voltage relative to the cathode 102 with a grid 106 being arranged to provide a triode. Moreover, a control can be performed in which the flow of electrons is cutoff with an electric field by applying, to the grid 106, a negative electric potential relative to the cathode 102, making it possible to control the flow of electrons more easily and conveniently than controlling a high voltage between the cathode 102 and the anode 103.

Either of the cases in FIG. 18 and FIG. 19 can be applied in an application in which electrons can be utilized directly, for example, with electrons being emitted from the electron gun 101 and the emitted electron beams being focused in a predetermined orientation by an electric field or magnetic field or in which they can be utilized indirectly in generating X rays with the energy at the time electrons are made to collide with a target, and, moreover, it can be applied in an application to accelerate electrons by a high-frequency electric field to increase energy, such as in Linac, to obtain higher electron energy or to accelerate/delay the electron flow and velocity modulated by a high-frequency electric field, such as in TWT or Klystron.

In either of the above-described application cases, not all of the emitted electron beams are transmitted to the following section (for example, Linac, TWT or the like), but reflection certainly occurs, so that some thereof return back to the electron gun 101 side (see WO2016/029065A1). Moreover, collision of electrons causes secondary electrons to be produced, which may move to the electron gun 101 side. In either of the cases, the energy that the electrons, the secondary electrons, or the ions have often causes damage to the grid 106 and the cathode 102 due to an overheating or shock when they collide with the grid 106 and the cathode 102.

Then, a method is known for preventing back bombardment to a cathode (a phenomenon in which only some electrons in electrons being emitted from the cathode and being in an accelerating phase obtain energy from a high-frequency electric field to return to the cathode and collide), as a structure called a hollow cathode with a through hole being formed at the center of the cathode, to avoid a temperature rise of the cathode due to return back of some of the electrons being emitted from the cathode, secondary electrons and ions being produced by the electrons colliding (see CN202633200U).

SUMMARY OF THE INVENTION

However, there is a problem that, even with the method disclosed in CN202633200U, with a hollow cathode, electrons emitted from the inner surface of a through hole being formed in a cathode can cause the trajectory of electrons to be disturbed, electron beam forming to be impaired, or unnecessary leakage current called dark current to be produced, the leakage current flowing in the anode direction from the cathode. Moreover, when an emitter material scattering due to evaporation or sputtering attaches in the through hole being formed in the cathode, electron emission occurs from the above-mentioned emitter material, similarly causing the trajectory of electrons to be disturbed, electron beam forming to be impaired, or dark current to be produced.

Thus, an object of the present disclosure is to provide an electron gun that can suppress emission of electrons from the inside of a through hole being formed in the cathode or the edge to be formed when opening the through hole on an electron emitting surface of cathode, and a manufacturing method for the electron gun.

To achieve the above-mentioned object, the present disclosure, in one aspect, relates to an electron gun comprising a cathode having an electron emitting surface and whose planar shape is circular; a heater; and an anode being arranged to oppose the cathode, wherein a through hole along a central axis of the cathode is provided in a central portion of the cathode, and a no-emitting layer is provided at at least one of an opening edge on the electron emitting surface side of the through hole and an inner surface of the through hole.

The above-mentioned aspect of the present disclosure being configured to provide the no-emitting layer can prevent the electron emission substance from being present at the opening edge on the electron emitting surface side of the through hole of the cathode or at the inner surface of the through hole, making it possible to eliminate emission of electrons from the through hole of the cathode. As a result, disturbance of electron beam forming and production of dark current can be prevented.

Moreover, the present disclosure, in another aspect, relates to an electron gun comprising a cathode having an electron emitting surface and whose planar shape is circular; a heater; and an anode being arranged to oppose the cathode, wherein a through hole along a central axis of the cathode is provided in a central portion of the cathode, and an opening edge on the electron emitting surface side of the through hole is a C chamfer or a R chamfer.

The above-mentioned another aspect of the present disclosure in which the opening edge of the through hole of the cathode is chamfered to form the C chamfer or the R chamfer makes it possible to eliminate emission of electrons from the opening edge of the through hole of the cathode and to prevent production of dark current.

DETAILED DESCRIPTION

Below, the present disclosure is described based on embodiments shown in FIGS. 1 to 17. Each of the figures is merely a figure to describe the schematic configuration of an electron gun 1 according to the present disclosure, so that it does not strictly represent the detailed structure of each of the portions or the mutual dimensional relationship between the portions.

Common Embodiment

Figure 1:
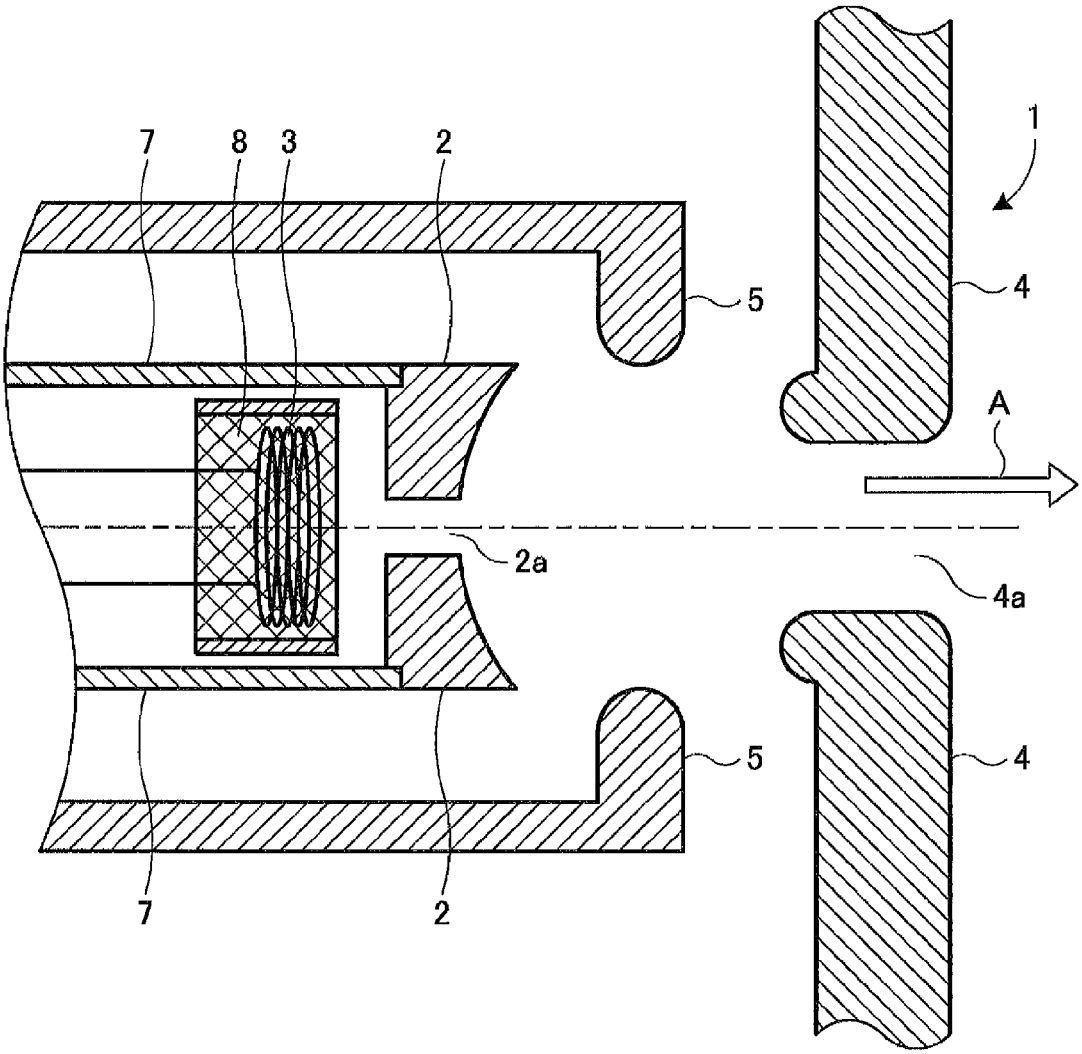
FIG. 1 is a cross-sectional view showing a schematic structure of a configuration to be the basis of an electron gun according to the present disclosure.

FIG. 1 is a cross-sectional view showing a schematic structure of a configuration to be a basis of an electronic gun 1 according to the present disclosure. The electron gun 1 shown in FIG. 1 is a diode electron gun. The electron gun 1 is configured differently from the related-art electron gun in that, primarily, it has a through hole 2*a* formed in a cathode 2, and is provided with a feature to suppress electron emission such as providing filling in the inner surface of the through hole 2*a* or the surrounding thereof. While such a feature is not specifically indicated in an explicit manner in FIG. 1, it is shown as a no-emitting layer 11, or a C chamfer or R chamfer in FIGS. 2 to 12. The term "no-emitting layer" herein means a layer in which exposure of an electron emission substance from the cathode is prevented, thereby causing electrons to be not emitted. While explanations will be omitted for the configuration equivalent to that according to the related art, the electron gun 1 schematically has the following configuration.

The electron gun 1 comprises the cathode 2; a heater 3; an anode 4; and a wehnelt 5 and it is to emit electrons primarily in an arrow A orientation from an opening 4*a* being formed in the anode 4. The electron gun 1 is housed in a housing (not shown) being formed with an insulating member, and operates with the interior of the electron gun 1 maintained in a vacuum while it is connected to a vacuum apparatus.

The electron gun 1 is used in combination with an application to utilize electron beams (for example, an electron beam generating apparatus, Linac, TWT, Klystron, or the like). At this time, some of electrons return back to the electron gun 1 side with reflection occurring on the application side, secondary electrons being produced by collision of the electrons return to the electron gun 1 side, or ions receiving energy from the electric field in a next application move toward to the electron gun 1 side. Such electrons, secondary electrons, and ions are called "returned back electrons" herein.

The electron gun 1 has the cathode 2 with the through hole 2*a* formed therein which is a structure called a hollow cathode. According to such electron gun 1, even in a case that returned back electrons that return back from the following section (for example, Linac, TWT or the like) move toward the cathode 2, they pass through the through hole 2*a* provided at the center of the cathode 2, making it possible to prevent a local heat generation at the center of the cathode 2. Therefore, even in an electron gun being designed with a very high electron beam current density, damaging of the cathode 2 can be prevented and, moreover, a temperature rising or degradation of the heater 3 or an insulating material 8 can be reduced.

The cathode 2 is supported by a sleeve 7 being conductive and, moreover, with the anode 4 and the wehnelt 5 being individually supported by each electrically separated conductive members, respectively, the mutual positional relationships in the housing are fixed.

The cathode 2 having an electron emitting surface and whose planar shape is circular is to be heated by the heater 3 and to emit electrons. While the electron emitting surface of the cathode 2 can be planar, the cathode 2 is primarily an electron beam focusing-type cathode being configured to be a concavely curved surface to focus the electron beams. The cathode 2 is formed by splaying onto, coating onto, or impregnating into a metal base body a thermionic emission substance, for example. For the metal base body making up the cathode 2, one being high in heat resistance, less in outgassing, and small in work function, for example, tungsten, is used. In a case of the metal base body making up an impregnated type cathode, a raw material which can be impregnated with an emitter material, for example, a porous metal, more specifically, a porous tungsten, a porous tungsten compound, a raw material in which the porous tungsten is doped with another element, is further used. An impregnating electron emission substance (emitter material) includes barium, calcium, rhenium, strontium, for example, or a compound containing these, and is used by mixing alumina at the time of impregnating. The thermal conductivity of the metal base body is preferably high, so that, for example, the thermal conductivity of tungsten is 173 ($W \cdot m^{-1} \cdot k^{-1}$). A predetermined negative electric potential relative to the anode 4 and the wehnelt 5 is applied to the cathode 2 by a power supply (not shown).

The through hole 2*a* is formed in the cathode 2 at the central portion thereof along the central axis of the cathode (along a direction being perpendicular to a circle being the planar shape of the cathode 2). The through hole 2*a* is to prevent the cathode 2 from being deformed by energy of back bombardment of returned back electrons advancing to the electron gun 1 side, or the electron emission substance or the metal base body itself from being degraded. The through hole 2*a* is formed, at the central portion of the cathode 2, as a hole whose cross section being orthogonal to the central axis of the cathode 2 (direction of an arrow A) is circular, the hole to penetrate the cathode 2 along the central axis of the cathode 2 (along the arrow A (the traveling direction of electrons)). While the diameter of the circle being a cross section of the through hole 2*a*, the cross section being orthogonal to the central axis of the cathode 2, is often set to approximately between 1 to 3 mm to give a mere example, it is set taking into account the electron beam diameter or the focusing electric field. The outer diameter of the cathode in this case is approximately between 3 and 15 mm. Moreover, the cross-sectional shape of the through hole 2*a* does not have to be circular as long as the size of the through hole 2*a* is approximately that of the circle.

The heater 3 is to heat the cathode 2. The heater 3 is surrounded and held by the insulating material 8. The insulating material 8 is formed with a material having insulating property and heat resistance, and is formed specifically by alumina, for example.

The anode 4 being arranged to oppose the cathode 2 is to advance electrons being emitted from the cathode 2 such that they are made to pass through the opening 4*a* thereof. A predetermined electric potential is applied to the anode 4 using a power supply (not shown).

The wehnelt 5 is an electrode to form the electric field distribution together with the anode 4 and cause the trajectory of the electrons emitted from the cathode 2 to be curved to thereby cause beams of the above-mentioned electrons to be focused. A predetermined electric potential is applied to the wehnelt 5 using a power supply (not shown).

According to the electron gun 1 having such a configuration, heating of the cathode 2 by the heater 3 causes thermionic emission, causing the movement direction of electrons caused by the electric field between the cathode 2 and the anode 4 to be determined and electron beams to be focused under the influence of the electric field by the wehnelt 5. In other words, the electrons emitted from the cathode 2 move toward the opening 4*a* of the anode 4 while they are focused by the voltage as a difference between the electric potential applied to the anode 4 and the electric potential applied to the cathode 2.

The configuration or the structure to be the basis of the electron gun 1 according to the present disclosure is not limited to the embodiments shown in each of the figures. More specifically, for example, arrangement of the heater 3 or the insulating material 8 is not limited to the embodiments shown in each of the figures. In other words, some of the electrons being emitted from the cathode 2 pass through the opening 4*a* of the anode 4, further move primarily to the arrow A orientation, and move toward the following section in which the electron beams are utilized (for example, Linac, TWT or the like). Then, in the following section, electrons collide with gas or ions being present in a small amount in a tube that should inherently be a vacuum in an ideal sense, some of the electrons are reflected due to an influence of the electric field, or returned back electrons such as secondary electrons that are produced by collision of the electron beams come back toward the cathode 2. Therefore, the heating wire of the heater 3 or the insulating material 8 being arranged coaxially with the through hole 2*a* of the cathode 2 causes it to be influenced by back bombardment, so that the heater 3 and the insulating material 8 can be arranged not coaxially with the through hole 2*a* of the cathode 2.

Embodiment 1

According to Embodiment 1, a metal layer 11*a* is provided as a no-emitting layer 11 on an opening edge on the electron emitting surface side of a through hole 2*a* or on an inner surface of the through hole 2*a* of a cathode 2. FIGS.

2 to 4 are cross-sectional views showing specific modes of an electron gun 1 according to Embodiment 1 with the cathode 2 being particularly enlarged. In other words, the metal layer 11*a* being the no-emitting layer 11 fills or covers a pore or convex-concavity being present in the opening edge on the electron emitting surface side of the through hole 2*a* or in the inner surface of the through hole 2*a* of the cathode 2 to prevent the electron emission substance from being exposed onto the surface, and as a result, prevents electron emission from this surface.

Figure 2:
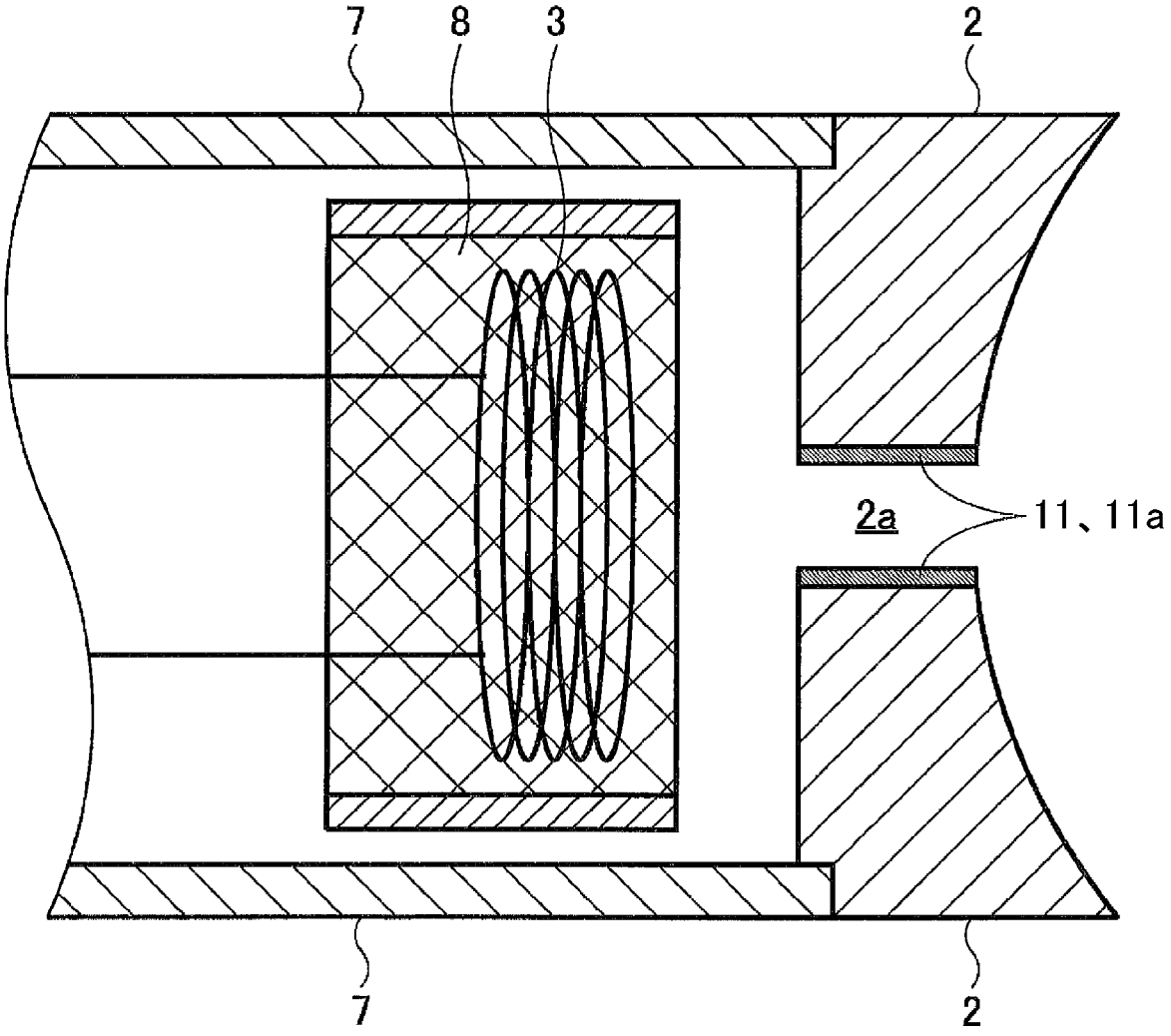
FIG. 2 is a cross-sectional view showing an electron gun according to Embodiment 1 of the present disclosure with a cathode being particularly enlarged, wherein a cylindrical metal layer is formed as a no-emitting layer in a through hole of the cathode.

The electron gun 1 shown in FIG. 2 is the electron gun comprising the cathode 2 having the electron emitting surface and whose planar shape is circular; the heater 3 to increase the temperature of the cathode 2; and the anode 4 to apply the positive electric potential relative to the cathode 2 to extract electrons in the predetermined direction (see FIG. 1), wherein the through hole 2*a* is provided at the central portion of the cathode 2 along the central axis of the cathode 2 (along an arrow A), and the cathode 2 comprises the metal layer 11*a* as the no-emitting layer on the inner surface of the through hole 2*a*.

The metal layer 11*a* is formed, for example, by attaching a powder-like or film-like metal and the like onto the inner surface of the through hole 2*a*, melting the attached metal, for example, through the heating in a furnace and then solidifying the melted metal through the cooling. In the metal layer 11*a*, the metal is coated and attached on the inner surface of the through hole 2*a* such that it covers the inner surface thereof over the entire periphery thereof and the above-mentioned metal is melted and solidified to be formed in a cylindrical shape. At this time, with the metal being coated or attached onto a metal base body at the inner surface of the through hole 2*a* of the cathode 2, the outer surface can be melted using laser irradiation, for example to cause the melted outer surface to completely cover the entire inner surface of the through hole 2*a*. The thickness of the metal layer 11*a* is not limited to particular dimensions, so that it can be appropriately adjusted to suitable dimensions while taking into account that the metal layer 11*a* can function as filling for the inner surface of the through hole 2*a*, for example. More specifically, the thickness of the metal layer 11*a* can be adjusted to between approximately 0.3 and 2 mm, for example.

Figure 3:
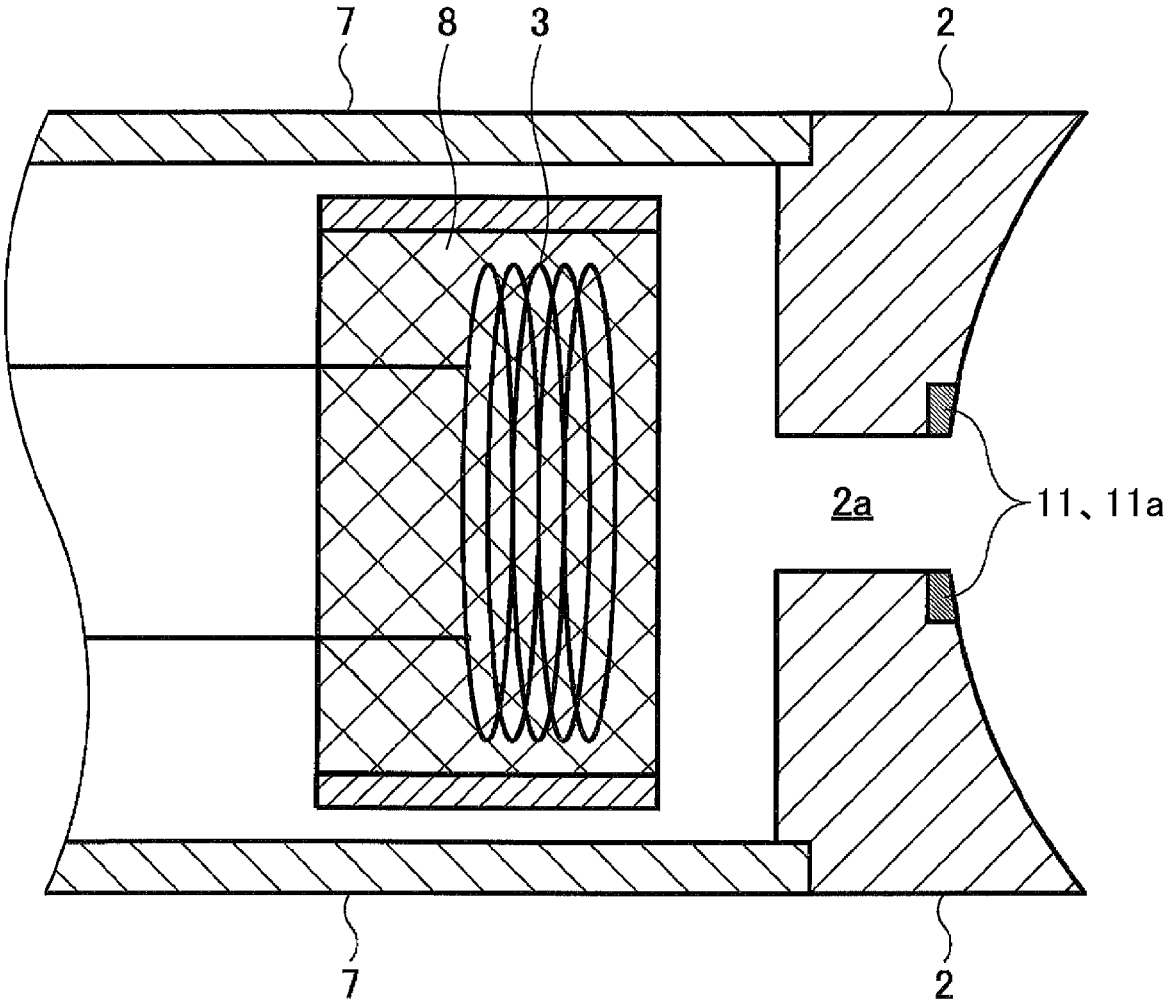
FIG. 3 is a cross-sectional view showing an electron gun according to Embodiment 1 of the present disclosure with a cathode being particularly enlarged, wherein an annular metal layer is formed as a no-emitting layer on an opening edge on an electron emitting surface side of a through hole of the cathode.

The electron gun 1 shown in FIG. 3 has a configuration similar to that of the electron gun 1 shown in FIG. 2 in the above, except that the metal layer 11*a* as the no-emitting layer 11 is provided in an annular shape on the opening edge on the electron emitting surface side of the through hole 2*a*. While the metal layer 11*a* as the no-emitting layer 11 is described as being formed in the outer shape of the cathode 2 (inside the cathode 2) in FIG. 3, the metal layer 11*a* can be provided so as to cover the opening edge on the electron emitting surface side of the through hole 2*a* of the cathode 2, or the metal layer 11*a* can be provided so as to cover the opening edge on the electron emitting surface side of the electron hole 2*a* of the cathode 2 and further the metal layer 11*a* can be extend to the inside of the cathode 2.

The metal layer 11*a* is formed by, for example, attaching a powder-like or film-like metal to the opening edge on the electron emitting surface side of the through hole 2, and after heating the attached powder-like or film-like metal in the furnace or by laser irradiation, for example, solidifying the melted metal (as shown in FIG. 3, this causes the metal layer 11*a* to be formed inside the cathode 2). In the metal layer 11*a*, a metal is coated to cover the entire periphery of the opening edge of the through hole 2*a* and this metal is melted and solidified to be formed in an annular shape. While a cross-sectional dimension of the metal layer 11*a* (the thickness of a ring) is not to be limited to particular numerical values, specifically, it can be adjusted to between approximately 0.3 and 1 mm, for example.

Figure 4:
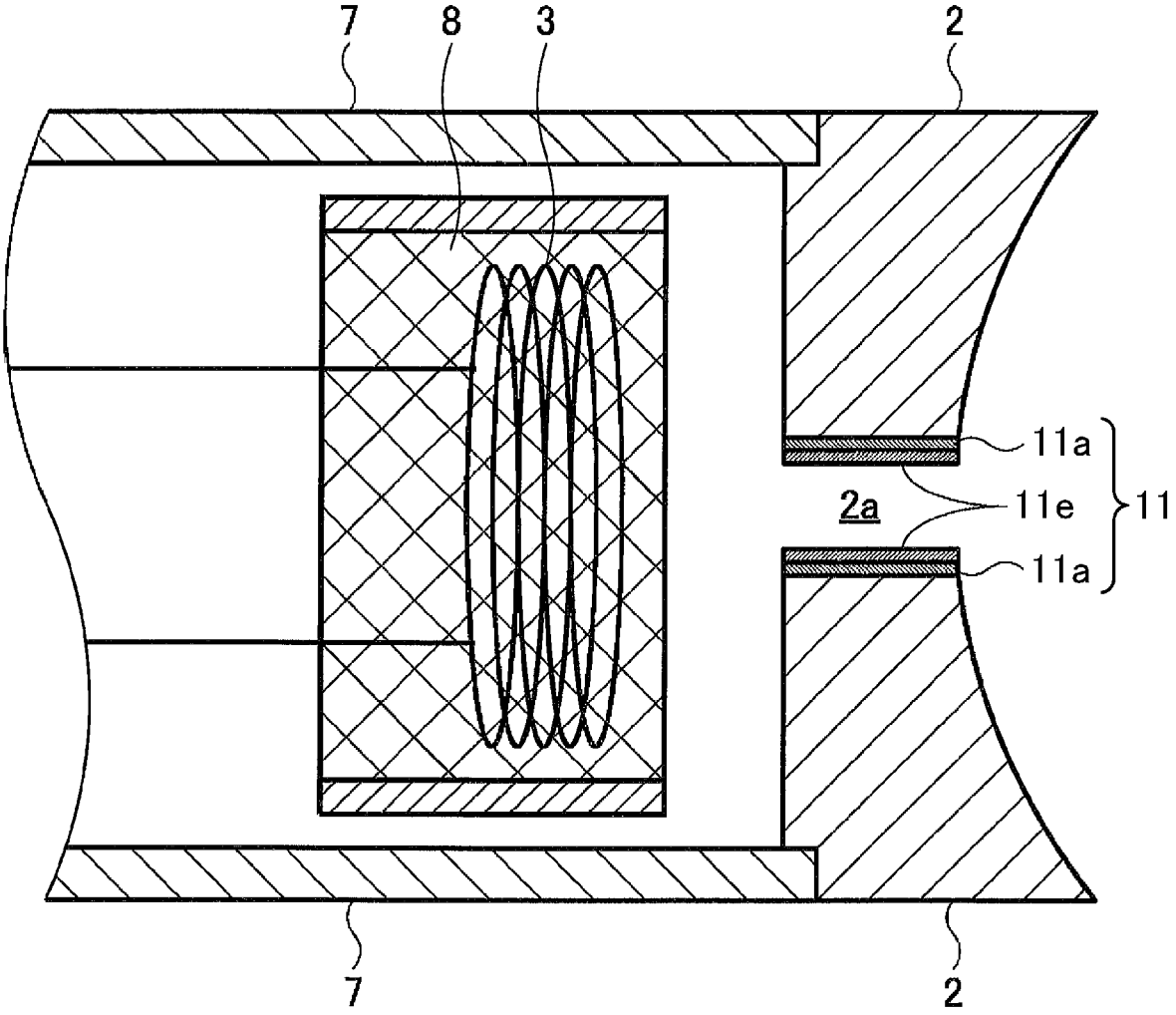
FIG. 4 is a cross-sectional view showing an electron gun according to Embodiment 1 of the present disclosure with a cathode being particularly enlarged, wherein a metal tube and a cylindrical metal layer are provided as a no-emitting layer in a through hole of the cathode.

The electron gun 1 shown in FIG. 4 has a configuration similar to that of the electron gun 1 shown in FIG. 2 in the above, except that the no-emitting layer 11 is a metal tube 11*e* being fixed to the through hole 2*a*. The metal tube 11*e* is fixed to the through hole 2*a* via the metal layer 11*a* being melted and solidified, for example by heating in the furnace between the metal tube 11*e* and the inner surface of the through hole 2*a*, and this metal tube 11*e* and the metal layer 11*a* form the no-emitting layer 11.

The metal tube 11*e* is formed as a tubular-shaped (cylindrically-shaped) metal member adjusted to dimensions being approximately the same as the length in the axial center direction of the through hole 2*a*. While the wall thickness of the metal tube 11*e* is not to be limited to particular dimensions, it can be adjusted to between approximately 0.3 and 2 mm, for example. The outer diameter of the metal tube 11*e* is adjusted taking into account that the metal layer 11*a* is formed between the outer peripheral surface of the metal tube 11*e* and the inner peripheral surface of the through hole 2*a* with the metal tube 11*e* being inserted to the through hole 2*a*. The metal tube 11*e* is fixed to the through hole 2*a* via the metal layer 11*a* being solidified to be formed between the metal tube 11*e* and the inner peripheral surface of the through hole 2*a*. As the metal tube 11*e* does not necessarily have to form a cylinder, it can be a tubular-shaped metal foil, so that it does not have to be self-standing as the cylinder.

The metal tube 11*e* is preferably formed with a highly heat-resistant material being a material that can be used stably without causing heat deformation or outgassing even at a temperature expected for the metal tube 11*e* at the time of use of the electron gun 1. The metal tube 11*e* is preferably formed with a metal being high in work function and low in secondary electron multiplier coefficient. This causes production of secondary electrons and tertiary electrons to be suppressed when returned back electrons advancing to the electron gun 1 side collide with the metal tube 11*e*, making it possible to prevent being affected by electron beams emitted from the electron gun 1. The metal tube 11*e* is formed specifically by a highly heat resistant member such as molybdenum, tungsten, tantalum or hafnium, or an alloy comprising such substances, or a compound or mixture thereof.

In this mode, the metal layer 11*a* is formed by attaching a powder-like or film-like metal between the outer peripheral surface of the metal tube 11*e* being inserted to the through hole 2*a*, and the inner peripheral surface of the through hole 2*a*, heating the attached metal in the furnace to melt and then cooling the melted metal to solidify. The metal layer 11*a* is formed such that a metal is arranged so as to fill a space in between the outer peripheral surface of the metal tube 11*e* and the inner peripheral surface of the through hole 2*a* over the entire periphery in the metal layer 11*a*, and the above-mentioned metal is solidified to cover the inner peripheral surface of the through hole 2*a*. The thickness of the metal layer 11*a* is not limited to particular dimensions, so that it can be appropriately adjusted to suitable dimensions while taking into account the dimensions being summed with the wall thickness of the metal tube 11*e*, for example. More specifically, the thickness of the metal layer 11*a* can be adjusted to between approximately 0.3 and 2 mm, for example.

As a metal for forming the metal layer 11*a* in Embodiment 1, a highly heat-resistant material being a material that can be used stably without causing heat deformation or outgassing even at a temperature expected for the cathode 2 at the time of using the electron gun 1 is preferably melted to be used. More specifically, as the metal for forming the metal layer 11*a*, molybdenum, or an alloy containing molybdenum, or a compound of molybdenum is used, for example. Using molybdenum, or the alloy containing molybdenum, or the compound of molybdenum makes it possible to form a metal layer for eliminating emission of electrons while satisfactorily providing filling of the opening edge on the electron emitting surface side of the through hole 2*a* or the inner surface of the through hole 2*a*. As the metal for forming the metal layer 11*a*, moreover, an alloy containing tungsten, tantalum or hafnium, or a compound or mixture of these substances can be used.

For the cathode 2, the cylindrical metal layer 11*a* or the metal tube 11*e* being fixed to the through hole 2*a* is provided and, moreover, the annular metal layer 11*a* can be further provided.

Embodiment 2

Figure 5:
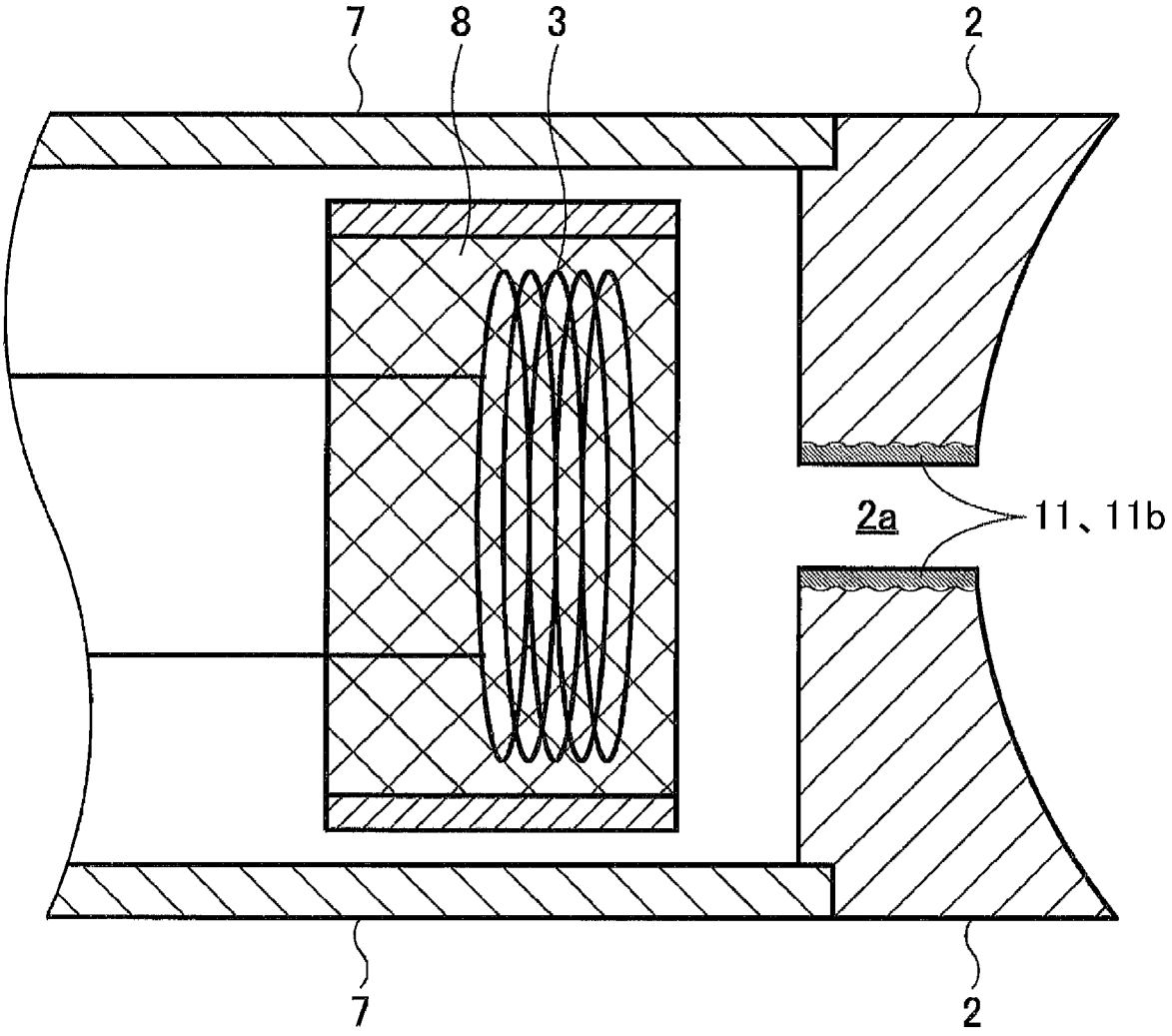
FIG. 5 is a cross-sectional view showing an electron gun according to Embodiment 2 of the present disclosure with a cathode being particularly enlarged, wherein a cylindrical metal layer in which a metal base body is melted and solidified is formed as a no-emitting layer in a through hole of the cathode.
Figure 6:
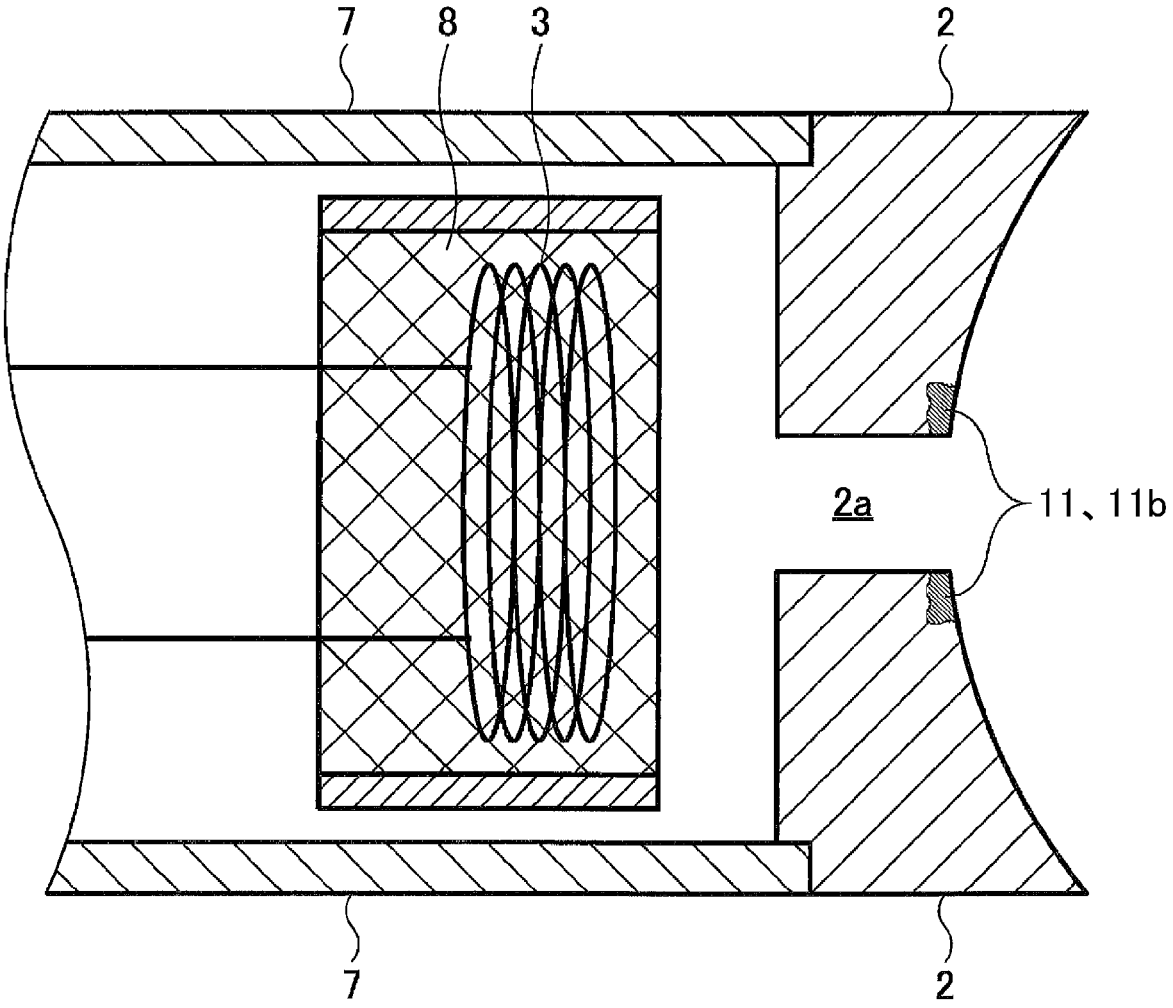
FIG. 6 is a cross-sectional view showing an electron gun according to Embodiment 2 of the present disclosure with a cathode being particularly enlarged, wherein an annular metal layer in which a metal base body is melted and solidified is formed as a no-emitting layer in an opening edge on an electron emitting surface side of a through hole of the cathode.

According to Embodiment 2, as the no-emitting layer 11*a* metal layer in which a metal base body is melted and solidified 11*b*, in which the metal base body makes up a cathode 2, is provided in an opening edge on an electron emitting surface side of the through hole 2*a* or in an inner surface of the through hole 2*a* of the cathode 2. FIGS. 5 and 6 are cross-sectional views showing specific modes of an electron gun 1 according to Embodiment 2 with the cathode 2 being particularly enlarged. In other words, the metal layer in which a metal base body is melted and solidified 11*b* being the no-emitting layer 11 closes a pore being present in the opening edge on the electron emitting surface side of the through hole 2*a* or in the inner surface of the through hole 2*a* of the cathode 2 to prevent the electron emission substance from being exposed onto the surface, and as a result, prevents electron emission from this surface.

The electron gun 1 shown in FIG. 5 is the electron gun comprising the cathode 2 having the electron emitting surface and whose planar shape is circular and comprising the metal base body and the electron emission substance; the heater 3 to increase the temperature of the cathode 2; and the anode 4 to apply the positive electric potential relative to the cathode 2 to extract electrons in the predetermined direction (see FIG. 1), wherein the through hole 2*a* is provided at the central portion of the cathode 2 along the central axis of the cathode 2 (along an arrow A), and the metal layer in which the metal base body is melted and solidified 11*b* is provided as the no-emitting layer 11 in the inner surface of the through hole 2*a*.

The metal layer in which the metal base body is melted and solidified 11*b* is formed by the surface layer portion of the inner surface of the through hole 2*a* of the metal base body making up the cathode 2 being melted to cause a melted metal to be generated and the melted metal being solidified. In the metal layer in which the metal base body is melted and solidified 11*b*, the metal base body at the surface layer portion over the entire periphery of the inner surface of the through hole 2*a* is melted to cause a melted metal to be generated and this melted metal is solidified to be formed in a cylindrical shape. The thickness of the metal layer in which the metal base body is melted and solidified 11*b* (the wall thickness of the cylinder) is not limited to particular dimensions, so that it can be appropriately adjusted to suitable dimensions while taking into account that it can function as filling for the inner peripheral surface of the through hole 2*a*, for example. More specifically, the thickness of the metal layer in which the metal base body is melted and solidified 11*b* (the wall thickness of the cylinder) can be adjusted to between approximately 0.3 and 2 mm, for example.

The electron gun 1 shown in FIG. 6 has a configuration similar to that of the electron gun 1 shown in FIG. 5 in the above, except that the metal layer in which the metal base body is melted and solidified 11*b* as the no-emitting layer 11 is provided in an annular shape in the opening edge on the electron emitting surface side of the through hole 2*a*.

The metal layer in which the metal base body is melted and solidified 11*b* is formed by the opening edge portion on the electron emitting surface side of the through hole 2*a* of the metal base body making up the cathode 2 being melted to cause a melted metal to be generated, and the melted metal being solidified. the metal layer in which the metal base body is melted and solidified 11*b* is formed in the annular shape by melting the edge portion surrounding the entire periphery of the opening of the through hole 2*a* of the metal base body to cause a melted metal to be formed and solidifying this melted metal. While a cross-sectional dimension of the metal layer in which the metal base body is melted and solidified 11*b* (the thickness of a ring) is not to be limited to particular numerical values, specifically, it can be adjusted to between approximately 0.3 and 2 mm, for example.

The manner in which a metal base body is melted to cause a melted metal to be formed according to Embodiment 2 is not limited to a particular technique, so that a suitable technique is appropriately selected taking into account the material of the metal base body, for example. The specific example includes a technique for forming a melted metal by melting the metal base body using laser. A technique for melting a powder-like or film-like metal attached to the through hole 2*a* by heating in the furnace and solidifying as in Embodiment 1 can cause the melted metal to get into the cathode 2. On the other hand, a technique for directly melting the metal base body using laser makes it possible to melt only the surface layer of the metal base body to form a melted metal without impregnating the metal base body with an excess metal. Therefore, the volume of the cathode that can be impregnated with an electron emission substance is greater than in Embodiment 1, and the life is extended. Moreover, using laser makes it possible to reduce the burden on forming the melted metal from the metal base body.

For the cathode 2, upon the cylindrical metal layer in which the metal base body is melted and solidified 11*b* being provided, the annular metal layer in which the metal base body is melted and solidified 11*b* can further be provided.

Embodiment 3

Figure 7:
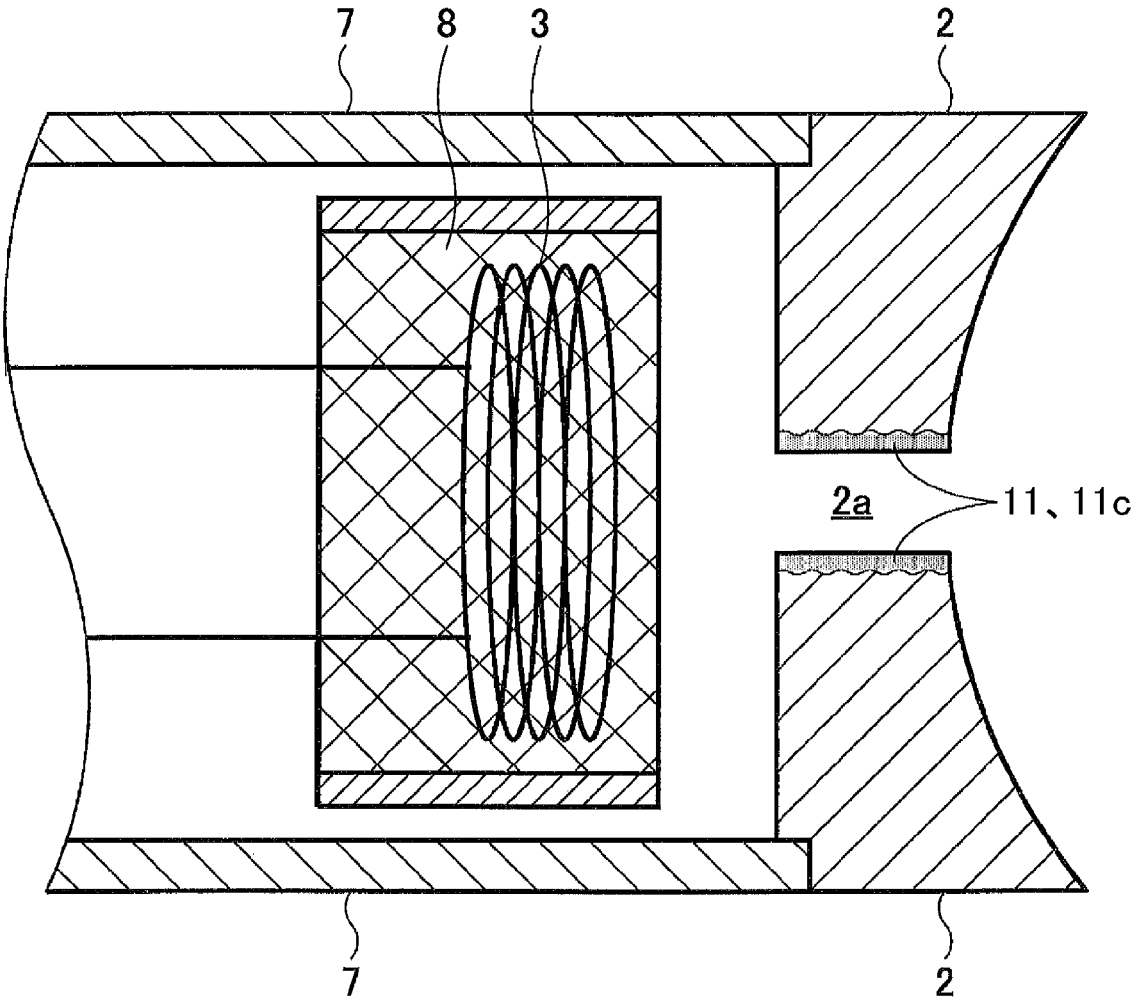
FIG. 7 is a cross-sectional view showing an electron gun according to Embodiment 3 of the present disclosure with a cathode being particularly enlarged, wherein a cylindrical layer consisting of only a porous metal base body is formed as a no-emitting layer in a through hole of the cathode.
Figure 8:
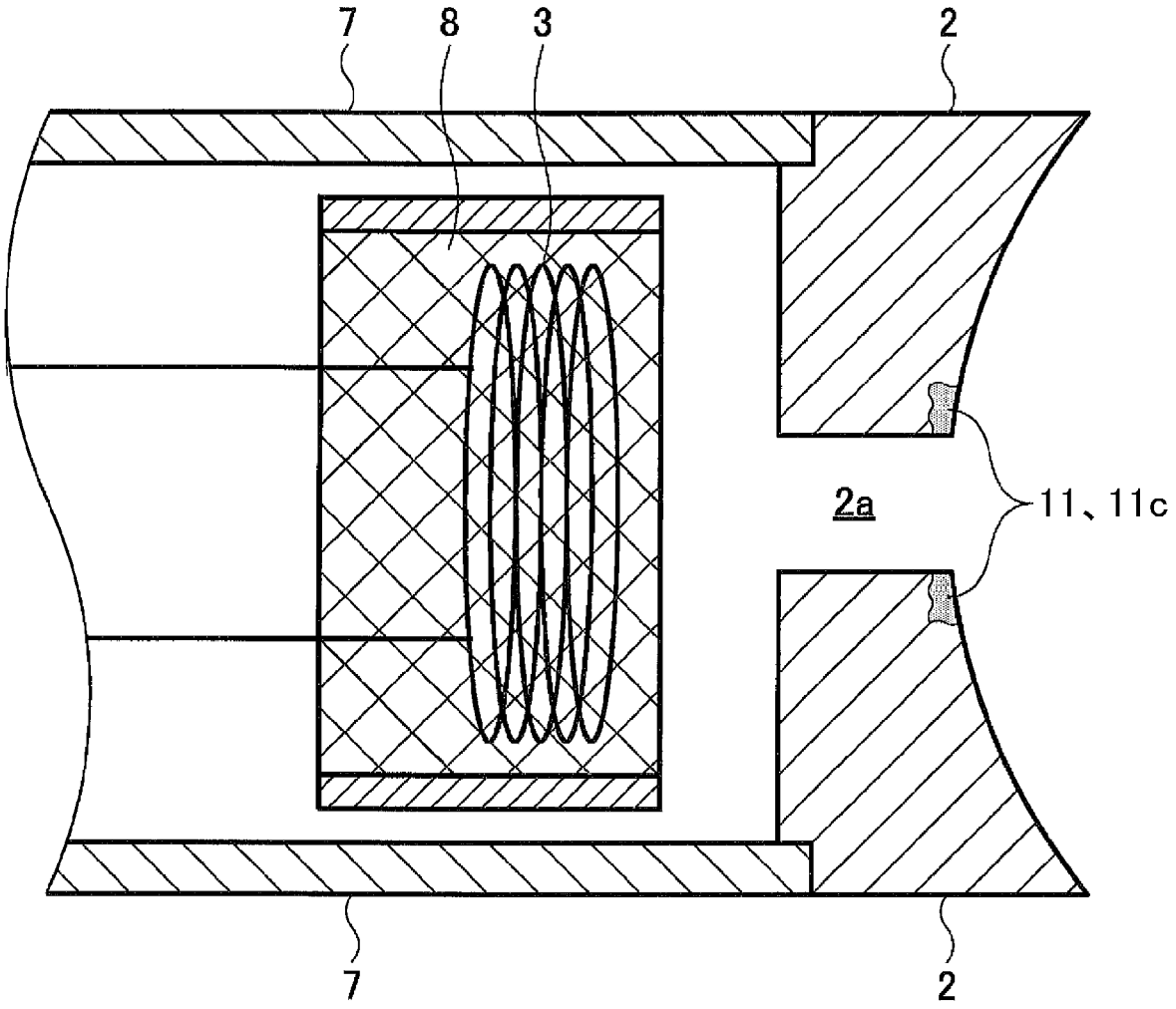
FIG. 8 is a cross-sectional view showing an electron gun according to Embodiment 3 of the present disclosure with a cathode being particularly enlarged, wherein an annular layer consisting of only a porous metal base body is formed as a no-emitting layer in an opening edge on the electron emitting surface side of a through hole of the cathode.

According to Embodiment 3, a layer consisting of only a porous metal base body 11*c* in which the metal base body makes up a cathode 2 is provided as a no-emitting layer 11 in an opening edge on an electron emitting surface side of a through hole 2*a* or in an inner surface of the through hole 2*a* of the cathode 2. FIGS. 7 and 8 are cross-sectional views of specific modes of an electron gun 1 according to Embodiment 3 with the cathode 2 being particularly enlarged.

The electron gun 1 shown in FIG. 7 is the electron gun comprising the cathode 2 having the electron emitting surface and whose planar shape is circular and comprising a porous metal base body and an electron emission substance with which a pore of the porous metal base body is impregnated; and a heater 3 to increase the temperature of the cathode 2; and an anode 4 to apply a positive electric potential relative to the cathode 2 to extract electrons in the predetermined direction (see FIG. 1), wherein the through hole 2*a* is provided in the central portion of the cathode 2 along the central axis of the cathode 2 (along an arrow A), and the layer consisting of only the porous metal base body 11*c* is provided as a no-emitting layer 11 in the inner surface of the through hole 2*a*.

The layer consisting of only the porous metal base body 11*c* is formed by removing the electron emission substance from the surface layer portion of the inner surface of the through hole 2*a* of the metal base body making up the cathode 2. The layer consisting of only the porous metal base body 11*c* is formed in a circular cylindrical shape by removing the electron emission substance from the surface layer portion of the metal base body over the entire periphery of the inner surface of the through hole 2*a*. While the thickness of the layer consisting of only the porous metal base body 11*c* (the wall thickness of a cylinder) is not to be limited to particular dimensions, specifically, it can be adjusted to between approximately 0.3 and 2 mm, for example. Since this prevents the electric field being generated with the anode 4 from getting into the cathode 2, electric field emission of electrons from the electron emission substance present at a location being deeper there than does not occur, making it possible to suppress leakage current (dark current).

The electron gun 1 shown in FIG. 8 has a configuration similar to that of the electron gun 1 shown in FIG. 7 in the above, except that the layer consisting of only the porous metal base body 11*c* as the non-emitting body 11 is provided in an annular shape in the opening edge on the electron emitting surface side of the through hole 2*a*.

The layer consisting of only the porous metal base body 11*c* is formed by removing the electron emission substance from the opening edge portion on the electron emitting surface side of the through hole 2*a* of the metal base body making up the cathode 2. The layer consisting of only the porous metal base body 11*c* is formed in an annular shape by removing the electron emission substance from the metal base body of an edge portion surrounding the entire periphery of an opening portion of the through hole 2*a*. While the thickness of the layer consisting of only the porous metal base body 11*c* (the thickness of a ring) is not to be limited to particular numerical values, specifically, it can be adjusted to between approximately 0.3 and 2 mm, for example.

The manner for removing the electron emission substance from the metal base body according to Embodiment 3 is not limited to a particular technique, so that a suitable technique is appropriately selected taking into account the material of the metal base body, for example. Specifical example of such technique includes a technique which comprises after impregnating the metal base body with the electron emission substance, soaking a surface of the porous metal base body of predetermined part (more specifically, the inner surface portion of the through hole 2*a*, the opening edge on the anode 4 side of the through hole 2*a*) of the cathode in pure water, ethanol, or a mixture liquid of pure water and ethanol to remove an electron emission substance with which the metal base body is impregnated from the metal base body. Using a particular substance in this way makes it possible to more appropriately remove the electron emission substance from a predetermined portion of the cathode 2.

For the cathode 2, upon the layer consisting of only the porous metal base body 11*c* in cylindrical shape being provided, the layer consisting of only the porous metal base body 11*c* in annular shape can be further provided.

Embodiment 4

Figure 9:
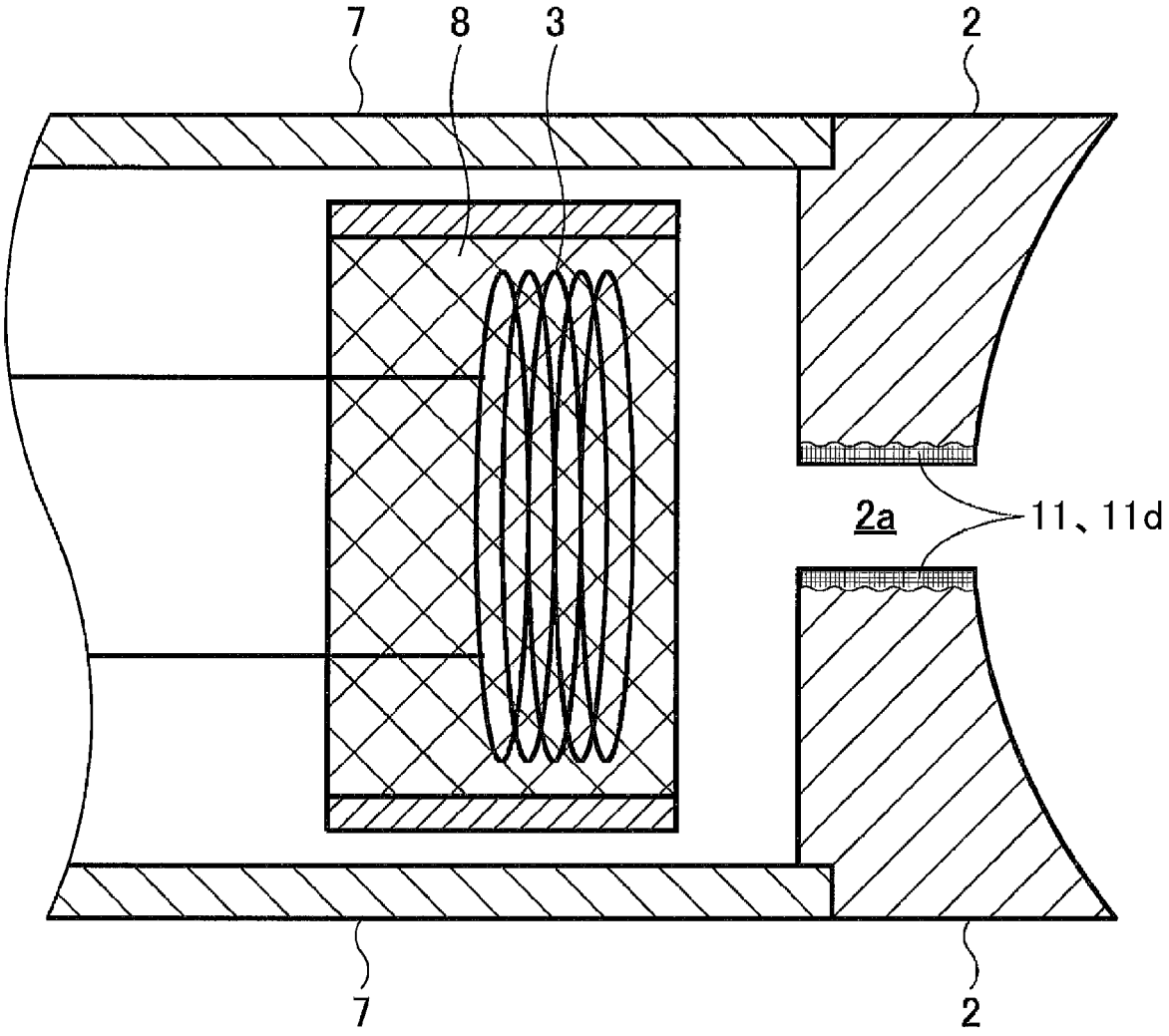
FIG. 9 is a cross-sectional view showing an electron gun according to Embodiment 4 of the present disclosure with a cathode being particularly enlarged, wherein a cylindrical layer in which a pore of a porous metal base body is impregnated with ceramic is formed as a no-emitting layer in a through hole of the cathode.
Figure 10:
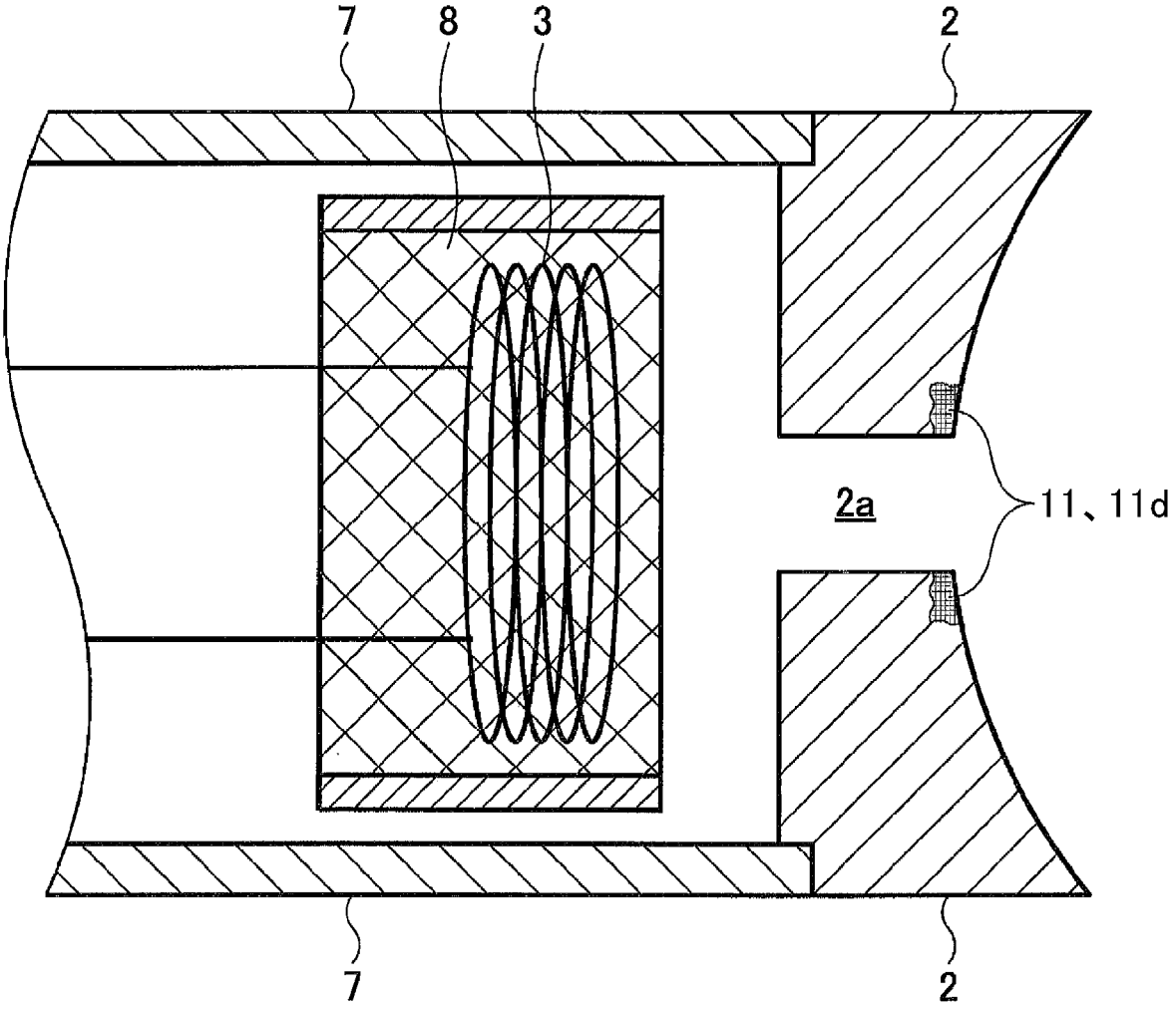
FIG. 10 is a cross-sectional view showing an electron gun according to Embodiment 4 of the present disclosure with a cathode being particularly enlarged, wherein an annular layer in which a pore of a porous metal base body is impregnated with ceramic is formed as a no-emitting layer in an opening edge on the electron emitting surface side of a through hole of the cathode.

According to Embodiment 4, a layer in which a pore of a porous metal base body is impregnated with ceramic 11*d*, in which the metal base body makes up a cathode 2, is provided as the no-emitting layer 11 in an opening edge on an electron emitting surface side of a through hole 2*a* or in an inner surface of the through hole 2*a* of the cathode 2. FIGS. 9 and 10 are cross-sectional views showing specific modes of the electron gun 1 according to Embodiment 4 with the cathode 2 being particularly enlarged. In other word, the layer in which the pore of the porous metal base body is impregnated with ceramic 11*d* being the no-emitting layer 11 fills or covers the pore or convex-concavity being present in the opening edge on the electron emitting surface side of the through hole 2*a* or in the inner surface of the through hole 2*a* of the cathode 2 to prevent the electron emission substance from being exposed onto the surface, and as a result, prevents electron emission from this surface. For the ceramic, a material with no outgassing even under a high-temperature vacuum environment is preferable, so that alumina ($Al_2O_3$) can be used, for example.

The electron gun 1 shown in FIG. 9 is the electron gun comprising the cathode 2 having the electron emitting surface and whose planar shape is circular and comprising a porous metal base body and an electron emission substance with which a pore of the porous metal base body is impregnated; a heater 3 to increase the temperature of the cathode 2; and an anode 4 to apply a positive electric potential relative to the cathode 2 to extract electrons in a predetermined direction (see FIG. 1), wherein the through hole 2*a* is provided at a central portion of the cathode 2 along a central axis of the cathode 2 (along an arrow A), and the cathode 2 comprises the layer in which the pore of the porous metal base body is impregnated with ceramic 11*d* as the no-emitting layer 11 in the inner surface of the through hole 2*a*.

The layer in which the pore of the porous metal base body is impregnated with ceramic 11*d* is formed by impregnating a surface layer portion of the inner surface of the through hole 2*a* of the metal base body making up the cathode 2 with a ceramic. The layer in which the pore of the porous metal base body is impregnated with ceramic 11*d* is formed in a cylindrical shape by impregnating the metal base body in the surface layer portion over the entire periphery of the inner surface of the through hole 2*a* with the ceramic. While the thickness of the layer in which the pore of the porous metal base body is impregnated with ceramic 11*d* (the wall thickness of a cylinder) is not to be limited to particular dimensions, specifically, it can be adjusted to between approximately 0.3 and 2 mm, for example.

The electron gun 1 shown in FIG. 10 has a configuration similar to that of the electron gun 1 shown in FIG. 9 in the above, except that the layer in which the pore of the porous metal base body is impregnated with ceramic 11*d* as the no-emitting layer 11 is provided in an annular shape in the opening edge on the electron emitting surface side of the through hole 2*a*.

The layer in which the pore of the porous metal base body is impregnated with ceramic 11*d* is formed by impregnating the opening edge portion on the electron emission surface side of the through hole 2*a* of the metal base body making up the cathode 2 with ceramic. The layer in which the pore of the porous metal base body is impregnated with ceramic 11*d* is formed in an annular shape by impregnating the metal base body of the edge portion surrounding the entire periphery of an opening of the through hole 2*a* with the ceramic. While a cross-sectional dimension of the layer in which the pore of the porous metal base body is impregnated with ceramic 11*d* (the thickness of a ring) is not to be limited to particular numerical values, specifically, it can be adjusted to between approximately 0.3 and 2 mm, for example.

For the cathode 2, upon the layer which the pore of the porous metal base body is impregnated with ceramic 11*d* in cylindrical shape being provided, the layer in which the pore of the porous metal base body is impregnated with ceramic 11*d* in annular shape can be further provided.

Embodiment 5

Figure 11:
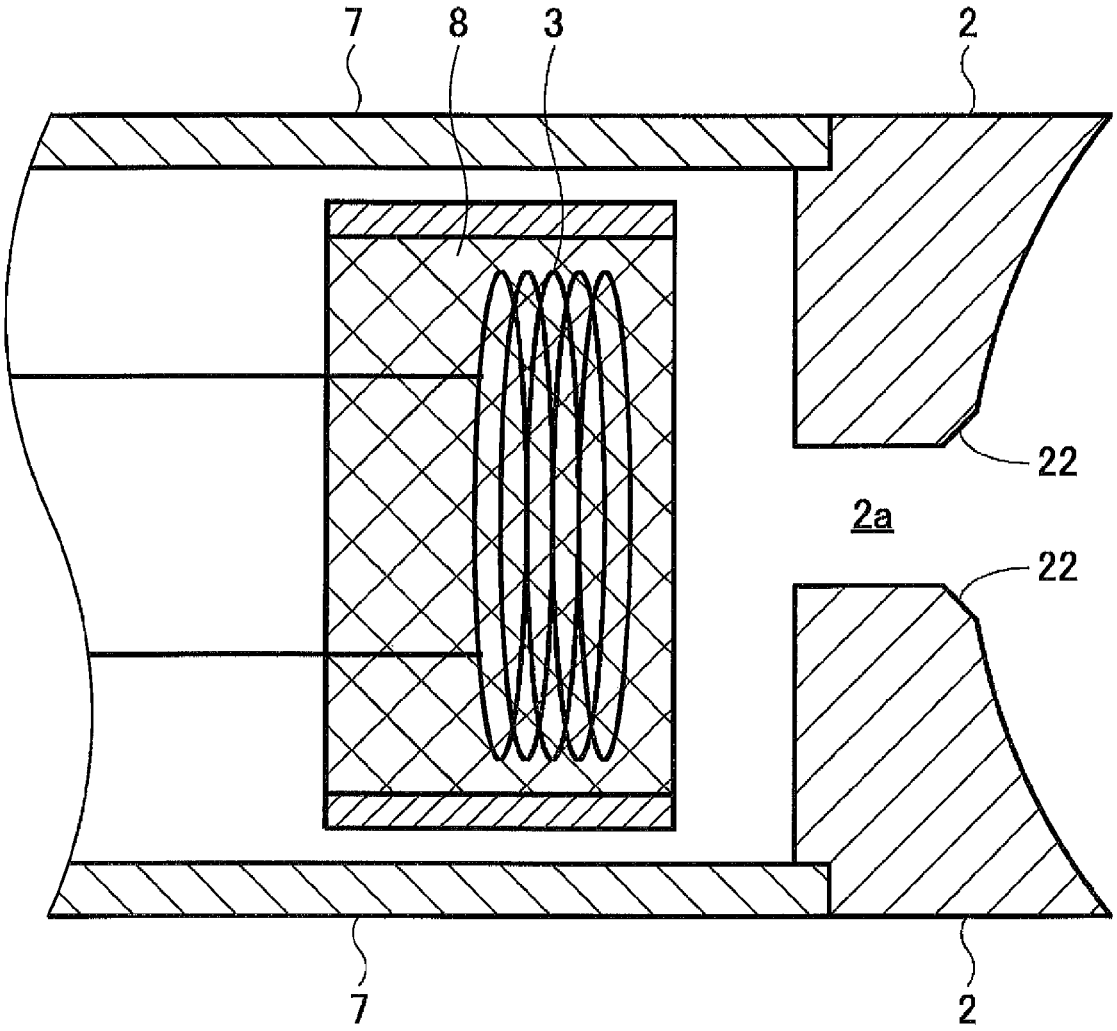
FIG. 11 is a cross-sectional view showing an electron gun according to Embodiment 5 of the present disclosure with a cathode being particularly enlarged, wherein an opening edge on an electron emitting surface side of a through hole of the cathode is a C chamfer.
Figure 12:
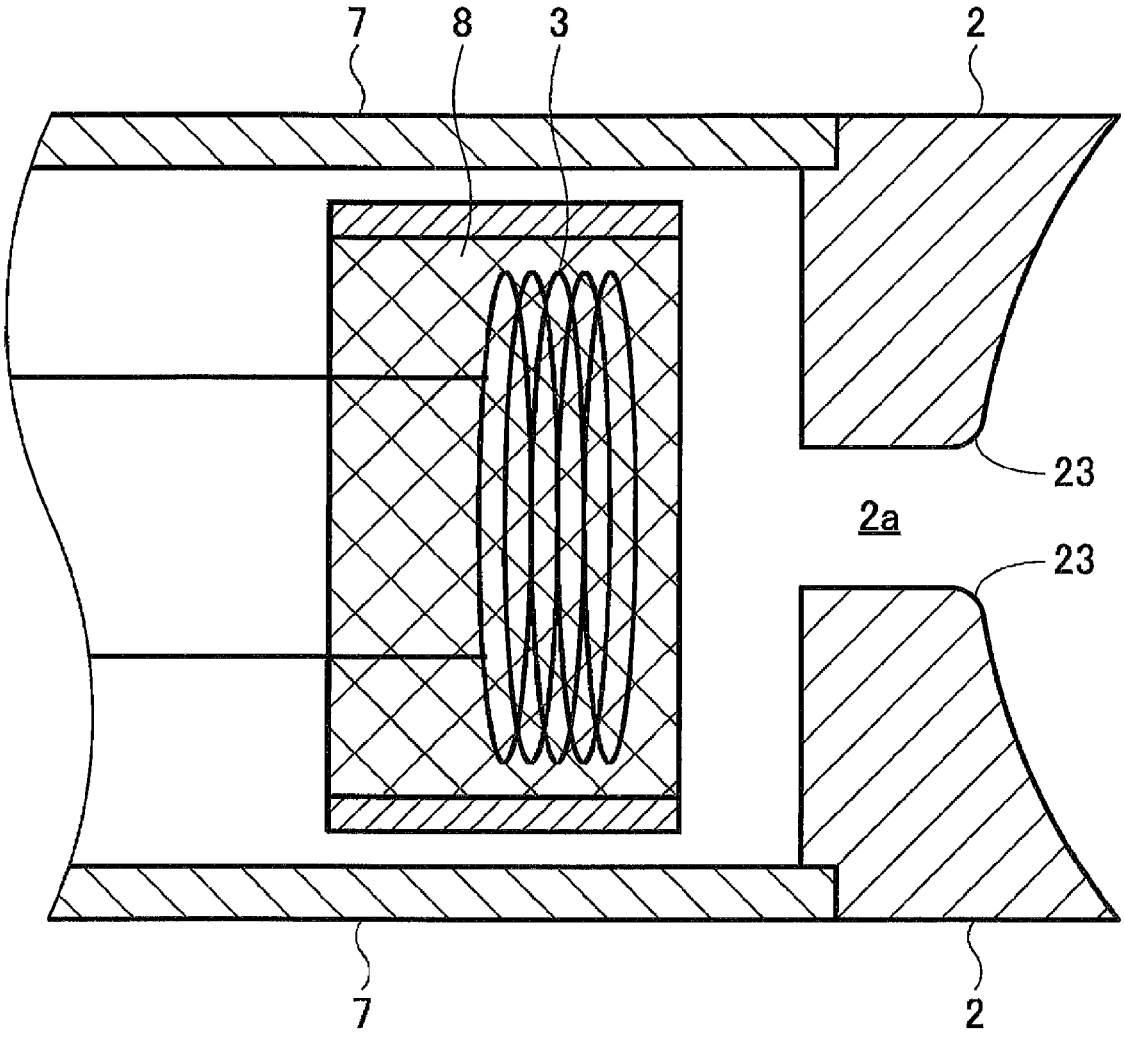
FIG. 12 is a cross-sectional view showing an electron gun according to Embodiment 5 of the present disclosure with a cathode being particularly enlarged, wherein an opening edge on an electron emitting surface side of a through hole of the cathode is a R chamfer.

FIGS. 11 and 12 are cross-sectional views showing an electron gun 1 according to Embodiment 5 with a cathode 2 being particularly enlarged. The electron gun 1 according to Embodiment 5 is an electron gun comprising the cathode 2 having an electron emitting surface and whose planar shape is circular; a heater 3 to increase the temperature of the cathode 2; and an anode 4 to apply a positive electric potential relative to the cathode 2 to extract electrons in a predetermined direction (see FIG. 1), wherein a through hole 2*a* is provided in the central portion of the cathode 2 along the central axis of the cathode 2 (along an arrow A), and the opening edge on the electron emitting surface side of the through hole 2*a* is configured to be a C chamfer (letter 22 in FIG. 11) or a R chamfer (letter 23 in FIG. 12).

The chamfering process to configure the C chamfer or the R chamfer is conducted so as to surround the opening edge of the through hole 2*a* of the cathode 2 over the entire periphery. The dimension or extent of the C chamfer or the R chamfer are not limited to particular numerical values, so that it can be appropriately adjusted to suitable numerical values while taking into account the range in which electrons being emitted from the opening edge of the through hole 2*a* are unlikely to be influenced by the electric field between the cathode and the anode, for example.

For the cathode 2, a cylindrical metal layer 11*a* or a metal tube 11*e* being fixed to the through hole 2*a* as described in Embodiment 1, a metal layer in which the metal base body is melted and solidified 11*b* in cylindrical shape as described in Embodiment 2, a layer consisting of only porous metal base body 11*c* in cylindrically-shape as described in Embodiment 3, or a layer in which the pore of the porous metal base body is impregnated with ceramic 11*d* in cylindrical shape as described in Embodiment 4 can be provided and, moreover, the opening edge of the thorough hole 2*a* can be C chamfer or R chamfer.

Embodiment 6

Figure 13:
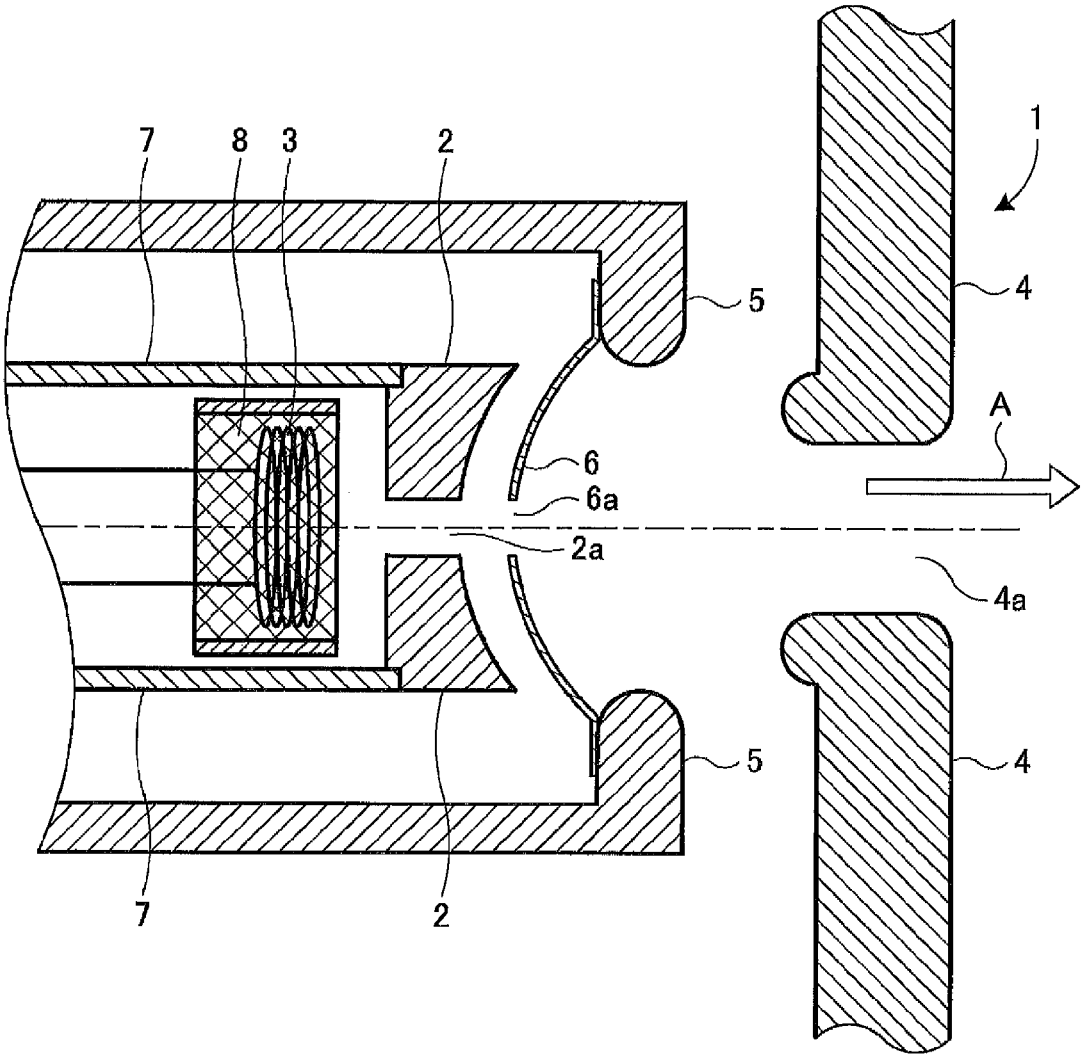
FIG. 13 is a cross-sectional view showing a schematic structure of another configuration to be the basis of an electron gun according to the present disclosure.

FIG. 13 is a cross-sectional view showing a schematic structure of another configuration to be a basis of an electron gun 1 according to the present disclosure. In the electron gun 1 shown in FIG. 13, in addition to the configuration being equivalent to the electron gun 1 shown in FIG. 1, a grid 6 is connected to a wehnelt 5. In other words, the electron gun 1 shown in FIG. 13 is a triode electron gun. For the configuration being equivalent to that of the electron gun 1 shown in FIG. 1, the explanations thereof will be omitted by affixing the same letters thereto.

The grid 6 being to control cathode current is installed on the cathode 2 side of the wehnelt 5. The grid 6 is driven by the electric potential being applied to the wehnelt 5. The grid 6 is formed as a structure having an opening ratio, such as a mesh or a punching shape through which electrons can transmit, using a material being conductive, for example. A voltage to be negative relative to an anode 4 is applied to the grid 6 (and thereby a positive control voltage to the cathode 2 is applied to the grid 6 to control the flow of electrons), making it possible to control cathode current by applying an electric field to further extract electrons from the cathode 2.

With the electric potential being applied to the wehnelt 5 as an incentive, the flow rate of electrons passing through the grid 6 from the cathode 2 to move in the orientation of an arrow A, or, in other words, cathode current, is controlled by the grid 6, making it possible to improve the operability of the electron gun 1.

Then, the electron gun 1 according to Embodiment 6 is configured such that it comprises the grid 6 between the cathode 2 and the anode 4 to control the flow rate of electrons and a hole 6*a* is provided in the grid 6 coaxially with a through hole 2*a* of the cathode 2.

The hole 6*a* is to prevent the thermally deforming or degrading on the grid 6 due to the energy of back bombardment of the returned back electrons returning back to the electron gun 1 side to pass therethrough. The hole 6*a* is formed at the central portion of the grid 6 as a circular hole that penetrates the grid 6 along the central axis of the cathode 2. The hole 6*a* of the grid 6 and the through hole 2*a* of the cathode 2 are respectively formed at positions to be coaxial along an emission direction A of electrons.

Figure 14:
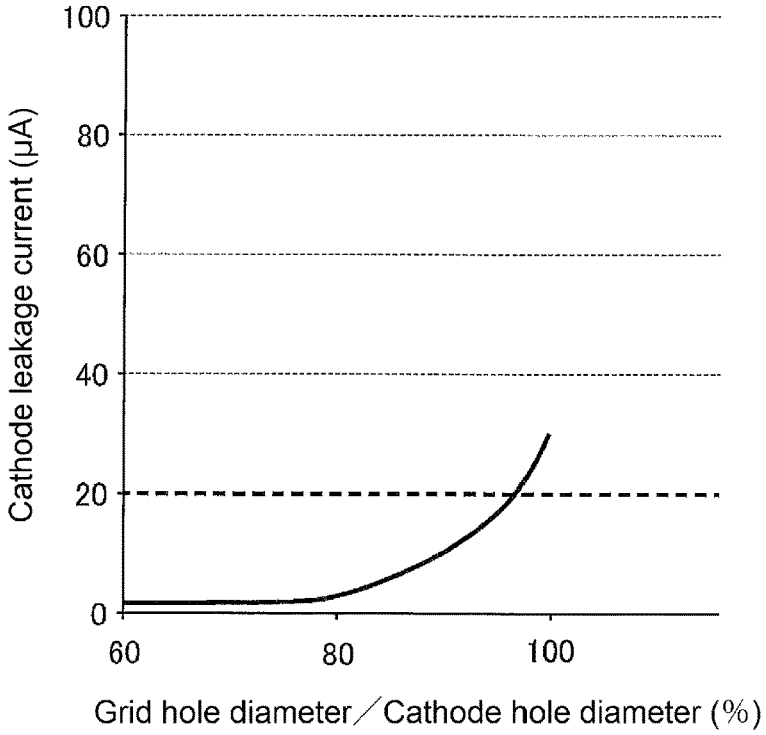
FIG. 14 is a graph showing a relationship between a ratio of a diameter of a hole in a grid to a diameter of a through hole of a cathode and cathode leakage current, in an electron gun according to the present disclosure.
Figure 15:
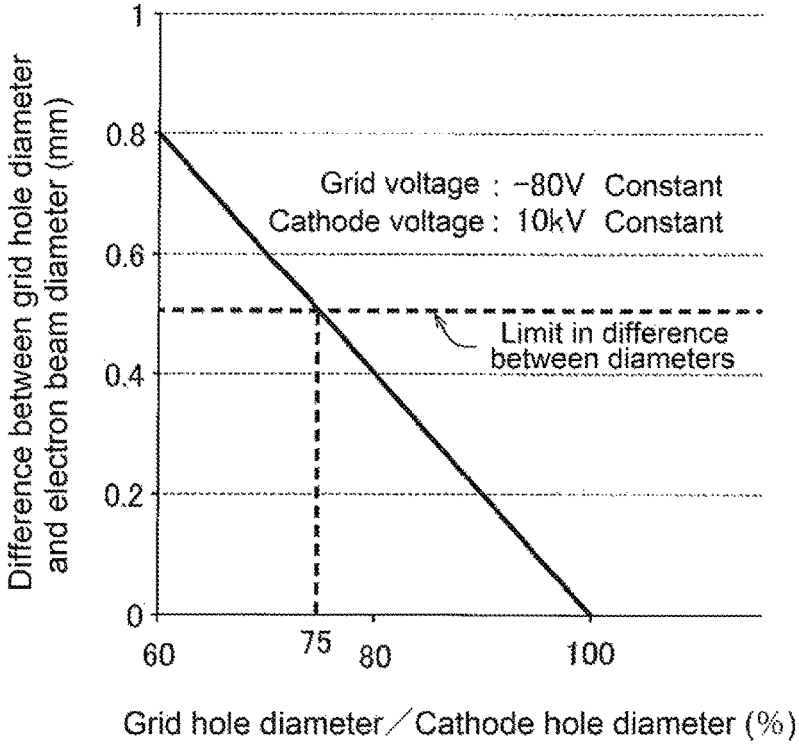
FIG. 15 is a graph showing a relationship between a ratio of a diameter of a hole in a grid to a diameter of a through hole of a cathode and a difference between the diameter of the hole of the grid and a diameter of electron beams, in an electron gun according to the present disclosure.

The diameter of a circle being a cross section of the hole 6*a* that is orthogonal to the central axis of the cathode 2 is preferably set to between 75 and 97% of the diameter of a circle being a cross section of the through hole 2*a* of the cathode 2 that is orthogonal to the central axis of the cathode 2. FIG. 14 is a graph showing the relationship between the ratio of the diameter of the hole 6*a* in the grid 6 to the diameter of the through hole 2*a* of the cathode 2 and cathode leakage current at the time of applying, to the grid 6, a predetermined negative electric potential relative to the cathode 2. The ratio of the diameter of the hole 6*a* in the grid 6 to the diameter of the through hole 2*a* of the cathode 2 being greater than or equal to 97% causes the cathode leakage current to increase, making it not possible to cut off cathode current. Moreover, similarly, also in a case of applying, to the grid 6, a positive electric potential relative to the cathode 2 to control cathode current, or, in other words, the flow rate of electrons, the ratio of the diameter of the hole 6*a* in the grid 6 to the diameter of the through hole 2*a* of the cathode 2 being greater than or equal to 97% makes it not possible to control cathode current unless the grid control voltage is made very large. FIG. 15 is a graph showing the relationship between the ratio of the diameter of the hole 6*a* in the grid 6 to the diameter of the through hole 2*a* of the cathode 2 and the difference between the diameter of the hole 6*a* of the grid 6 and the diameter of electron beams. The ratio of the diameter of the hole 6*a* in the grid 6 to the diameter of the through hole 2*a* of the cathode 2 being less than or equal to 75% causes the limit in the difference between the diameter of the hole 6*a* in the grid 6 and the diameter of electron beams to be less than or equal to 0.5 mm, causing position adjustment to be difficult. Therefore, the ratio of the diameter of the hole 6*a* in the grid 6 to the diameter of the through hole 2*a* of the cathode 2 is the most preferably between 75 and 97%, causing a leakage, from a hole being formed in a grid, of electrons being emitted from the vicinity of the center of the cathode to be eliminated, making it possible to prevent production of dark current and, moreover, also allow prevention of damaging of the grid due to back bombardment, which is the original object. In a case that the through hole 2*a* of the cathode 2 and the hole 6 in the grid 6 are not circular, the average diameter can be used.

By the electron gun 1 being provided with the grid 6 and the hole 6*a* being formed in the above-mentioned grid 6, returned back electrons that return back to the electron gun 1 pass through the hole 6*a* in the grid 6. The electron gun 1, as such, being configured to provide, upon providing the grid 6, the hole 6*a* in the grid 6 makes it possible to control the flow rate of electrons that move through the grid 6 from the cathode 2, or, in other words, cathode current, making it possible to improve the operability of the electron gun 1, and, moreover, to suppress a local heat generation in the central portion of the grid 6, and to protect the grid 6 from being damaged.

Embodiment 7

Figure 16:
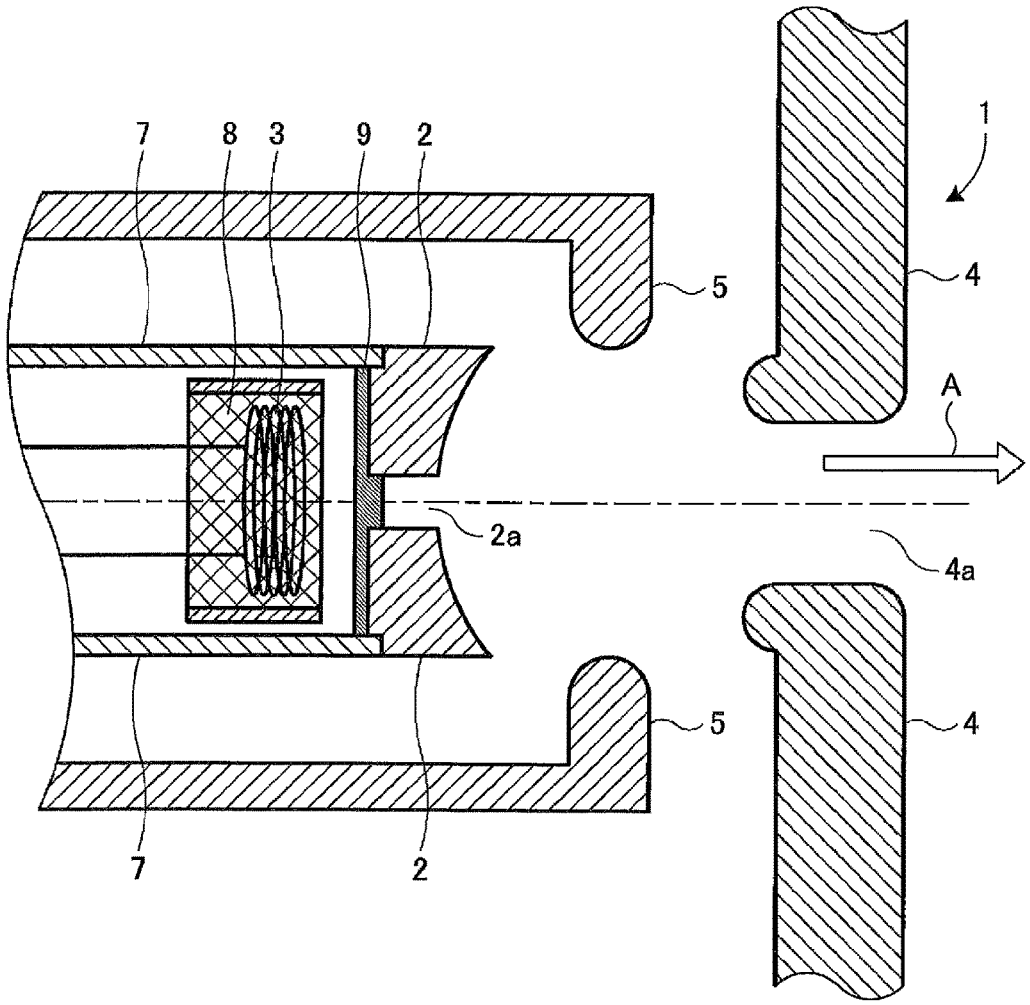
FIG. 16 is a cross-sectional view showing a schematic structure of yet another configuration to be the basis of an electron gun according to the present disclosure.

FIG. 16 is a cross-sectional view showing a schematic structure of yet another configuration to be a basis of an electron gun according to the present disclosure. In the electron gun 1 shown in FIG. 16, in addition to the configuration being equivalent to the electron gun 1 shown in FIG. 1, a heat resistant member 9 is provided in the through hole 2*a* of the cathode 2. For the configuration being equivalent to that of the electron gun 1 shown in FIG. 1, the explanations thereof will be omitted by affixing the same letters.

The electron gun 1 shown in FIG. 16 is configured such that the heat resistant member 9 having a first portion to close the through hole 2*a* of the cathode 2 (a projection 92 in Embodiment 7) and a second portion being positioned between the cathode 2 and a heater 3 (a flat plate-like portion 91 in Embodiment 7) is arranged therein.

The heat resistant member 9 is to collect returned back electrons that return back through the through hole 2*a* being provided in the cathode 2 to prevent damage to a component and, at the same time, diffuse heat generated by collision. The heat resistant member 9 is formed to cover the through hole 2*a* being provided in the cathode 2 without gaps to close the through hole 2*a*, is installed on the bottom surface (the end surface on the heater 3 side) of the cathode 2, and is preferably joined to the bottom surface of the cathode 2. Moreover, the heat resistant member 9 is preferably provided such that a part thereof comes into contact with the sleeve 7. The heat resistant member 9 comes into contact with the bottom surface of the cathode 2, or the sleeve 7 to cause heat of the heat resistant member 9 to be conducted to the cathode 2. Furthermore, the heat resistant member 9 cuts off the cathode 2 from the heater 3 side comprising an insulating material 8 to prevent an occurrence of an insulation failure due to an electron emission substance, for example, barium ions, being contained in the cathode 2 flowing to the heater 3 side.

The heat resistant member 9 is formed with a material having a high heat resistance and is preferably formed with a material that can be used stably without causing heat deformation or outgassing even at a temperature expected for the heat resistant member 9 at the time of using the electron gun 1. Moreover, preferably, the heat resistant member 9 is formed with a metal being high in work function and low in secondary electron yield. This makes it possible to suppress production of secondary electrons and tertiary electrons at the time the returned back electrons that return back to the electron gun 1 side collide with the heat resistant member 9 and to prevent electron beams being emitted from the electron gun 1 from being influenced. The heat resistant member 9 preferably has the heat conductivity being greater than that of the cathode 2. This is because it is good functioned to diffuse heat due to back bombardment over the entire cathode 2 while avoiding local heating. However, even when the heat conductivity of the heat resistant member 9 is the same as that of the cathode 2, it is effective in that the surface of the cathode 2 can avoid a shock due to the returned back electrons. Specifically, the heat resistant member 9 is formed with a highly heat resistant member such as molybdenum (with the heat conductivity of 138 $W \cdot m^{-1} \cdot k^{-1}$), tungsten, tantalum or hafnium, or a compound or mixture of these, or an alloy containing these, for example. Alternatively, the heat resistant member 9 can be formed with ceramics or SiC (silicon carbide).

The heat resistant member 9 and the cathode 2 can be made to have the same electric potential by forming the heat resistant member 9 with a metal and electrically connecting the heat resistant member 9 to a part to be the same electric potential as that of the cathode 2 (or, possibly, by installing the heat resistant member 9 to the cathode 2). This never blocks the workings of making electrons being emitted from the cathode 2 move such that they move toward the opening 4*a* of the anode 4 by the voltage as a difference between the electric potential applied to the anode 4 and the electric potential applied to the cathode 2. In other words, the heat resistant member 9 can be provided upon avoiding the functioning as the electron gun 1 being blocked.

Here, as the insulating material 8 is formed with a material having heat resistance, most of the heating of the cathode 2 uses heat conduction or heat radiation through the insulating material 8 or the sleeve 7, not direct radiation from the heater 3. According to a study by the inventors, it has been confirmed that the efficiency of heating the cathode 2 using the heater 3 does not significantly decrease because the thickness of the heat resistant member 9 is suitably adjusted. In other words, the heat resistant member 9 can be suitably placed to diffuse the heat on surface of the cathode 2 caused by the collision of return back electrons and be adjusted to not significantly decrease the efficiency of heating the cathode 2 by the heater 3.

While being dependent on the physical property of the heat resistant member 9, according to a study by the inventors, it has been confirmed that it is possible to ensure that the efficiency of heating the cathode 2 using the heater 3 do not significantly decrease by bringing the thickness of a portion (the thickness of a flat plate-like portion) of the heat resistant member 9 that exists between the heater 3 and the cathode 2 to be no greater than 1 mm, for example. In such case, the thickness of a projection (the thickness of a portion protruding from the flat plate-like portion) can be between 0.3 and 2.5 mm.

While the heat resistant member 9 can be formed in a mere flat plate shape with both the surface and the bottom thereof being planar (in other words, formed so as to have a constant thickness in an emission direction A of the electrons), to ensure that the efficiency of heating the cathode 2 using the heater 3 do not significantly decrease while effectively preventing a mechanical degradation such as deforming of or changing the surface state of the heat resistant member 9 due to the energy of back bombardment of the returned back electrons, a portion in which the returned back electrons that pass through the through hole 2*a* of the cathode 2 collide (a portion opposing the through hole 2*a*) can be made thicker while the other portion (a portion not opposing the through hole 2*a*) can be made thinner.

Figure 17:
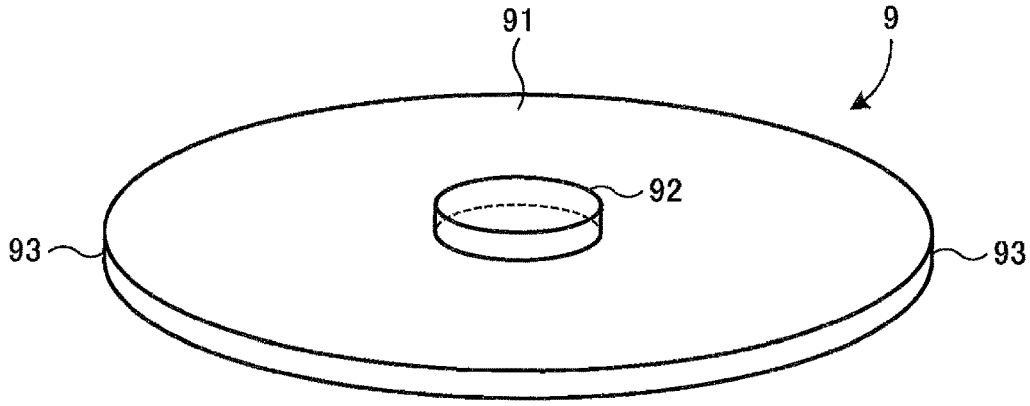
FIG. 17 is a perspective view showing a heat resistant member of the electron gun in FIG. 16.
Figure 18:
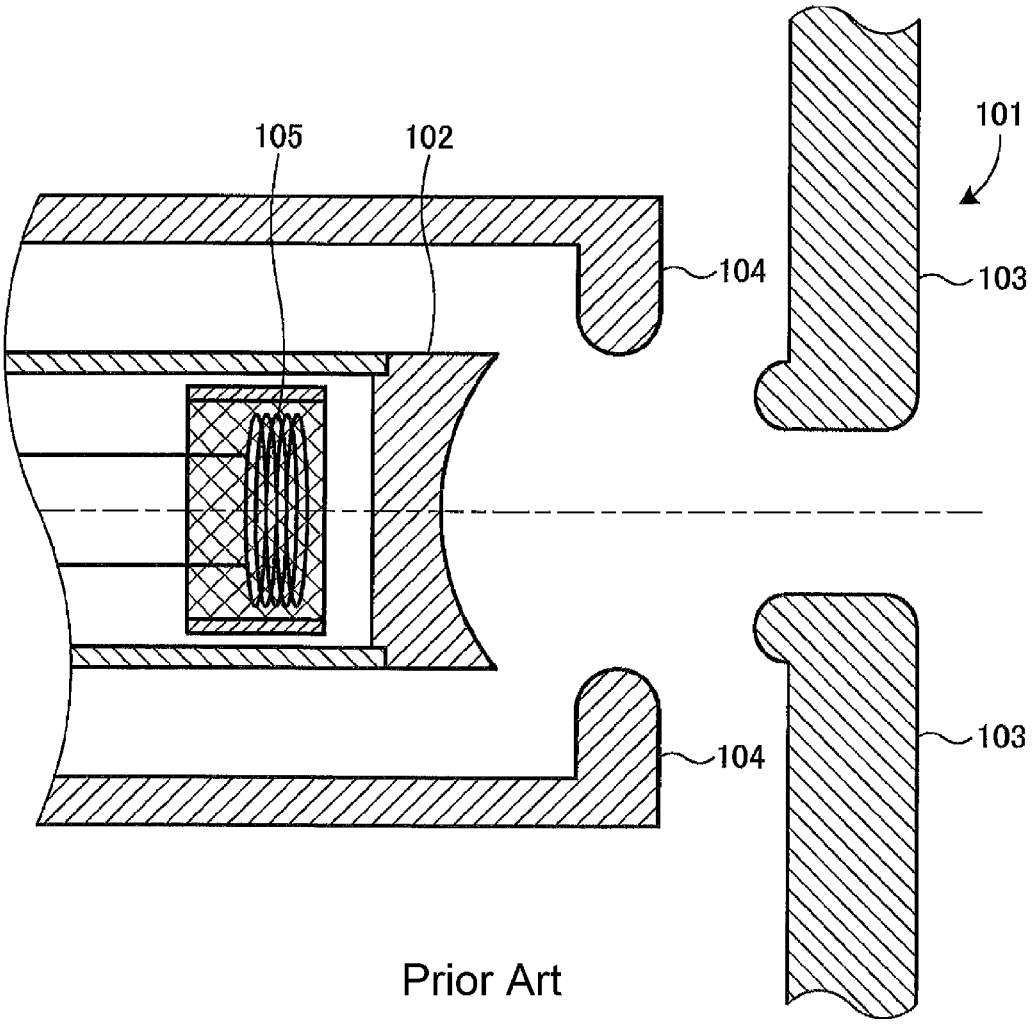
FIG. 18 is a cross-sectional view showing a schematic configuration of a diode electron gun according to the related art.
Figure 19:
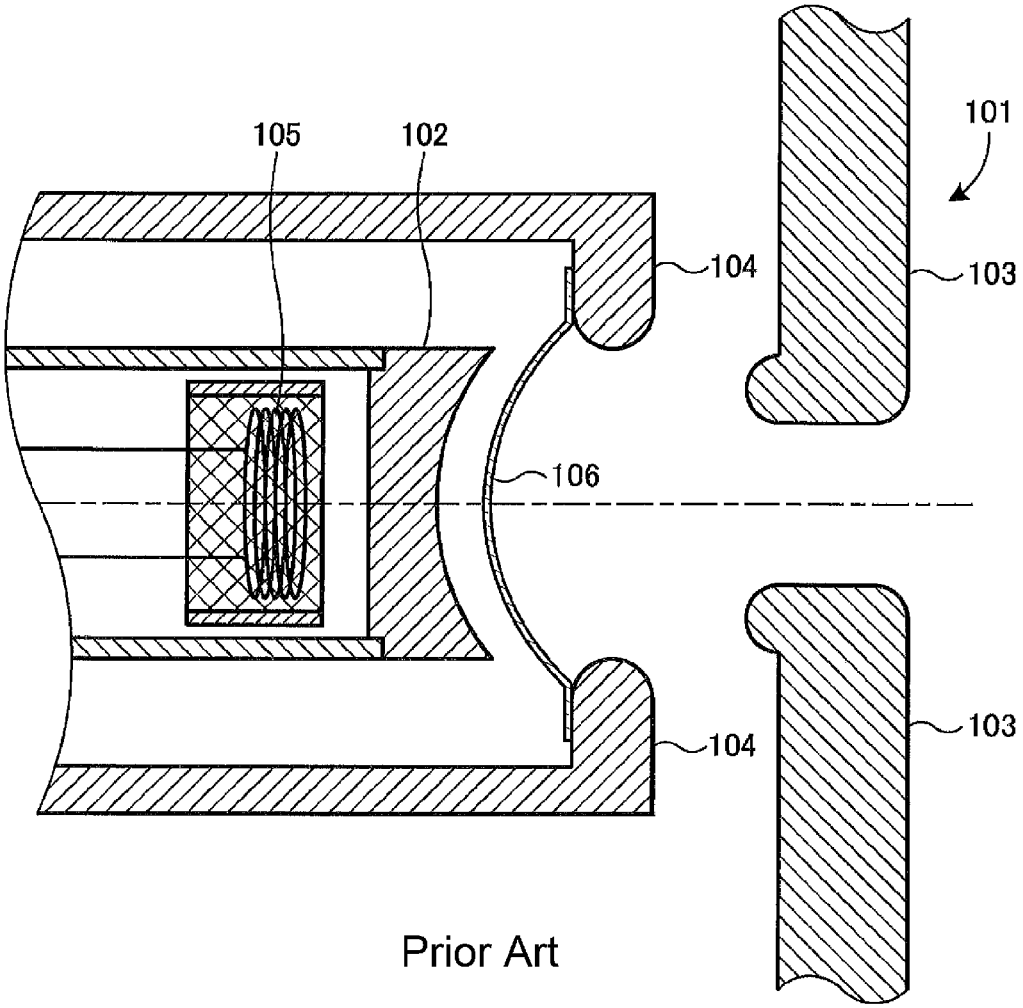
FIG. 19 is a cross-sectional view showing a schematic configuration of a triode electron gun according to the related art.

Specifically, the heat resistant member 9 can be formed into a shape as shown in FIG. 17, for example. The heat resistant member 9 shown in FIG. 17, wherein only a portion in which the returned back electrons passing through the through hole 2*a* of the cathode 2 collide is made thicker, comprises a flat plate-like portion 91 and a projection 92 formed on one surface of the flat plate-like portion 91. The heat resistance member 9 is installed to the cathode 2 by the flat plate-like portion 91 being joined to the end surface on the heater 3 side of the cathode 2 (the bottom surface of the cathode 2), in this configuration the projection 92 is fitted into the through hole 2*a* of the cathode 2. In the example shown in FIG. 17, the flat plate-like portion 91 is formed into a circle and is made to be the flat plate-like portion 91 being circular. The form of the projection 92 is construed to be not limited to be that of a coin type as shown in FIG. 17, so that it can also be of a type of a mountain having a foot.

A peripheral end 93 of the flat plate-like portion 91 being circular of the heat resistant member 9 is brought to be in contact with the sleeve 7 over the entire periphery thereof. This makes it possible to maintain well the operation of conducting heat of the heat resistant member 9 to the sleeve 7.

One or a plurality of holes can be formed in the flat plate-like portion 91 of the heat resistant member 8. Having the hole formed in the flat plate-like portion 91 makes it possible to efficiently conduct radiant heat from the heater 3 (heat through the insulating material 8 or the sleeve 7) to the cathode 2 while securing the operation of conducting heat of the heat resistant member 9 to the sleeve 7 to secure the eating efficiency of the cathode 2.

As long as a portion in which the returned back electrons that reach the heat resistant member 9 through the through hole 2*a* of the cathode 2 collide (a portion opposing the through hole 2*a*; a portion opposing the through hole 2*a*, including the projection 92 in the example shown in FIG. 17) is formed with a material having heat resistance, the whole can be formed as one entity (a one-piece component) or it can be configured with a plurality of components in a combination.

Here, some of the electrons being emitted from the cathode 2 pass through the opening 4*a* of the anode 4, further move primarily in the arrow A orientation, and move toward the following section in which the electron beams are utilized (for example, Linac, TWT or the like). Then, in the following section, electrons collide with gas or ions that exist in a small amount in a tube that should inherently be a vacuum in an ideal sense, and return back electrons such as some of the electrons being reflected due to an influence by the electric field, or secondary electrons being produced by collision of the electron beams return back toward the cathode 2. However, in a case of the electron gun 1 according to Embodiment 7, the returned back electrons that return back to the cathode 2 collide with the heat resistant member 9 via the through hole 2*a*, and heat generated by the back bombardment of the returned back electrons is diffused by the heat resistant member 9 and is mainly conducted to the bottom surface or the sleeve 7 side of the cathode 2. Some of the heat contributes to a temperature rise of the cathode 2 but the heat is that conducted from the bottom surface of the cathode 2 or the inner surface of the through hole 2*a*. Therefore, the heat is slight relative to the heat value of heating by the heater 3, but contributes to heating of the entire cathode 2 in the same manner as heating by the heater 3. Therefore, since it is not brought to a local heat generation at the center of the cathode 2 as in the related art, a thermionic emission substance being with which the surface of the cathode 2 or space (a void or pore) of a porous base metal is impregnated, abnormally causing evaporation is prevented.

According to the electron gun 1 of Embodiment 7, even in a case that returned back electrons that return back from the following section (for example, Linac, TWT or the like) utilizing electron beams being emitted from the electron gun 1 move toward the cathode 2, they pass through the through hole 2*a* provided at the center of the cathode 2, making it possible to suppress a local shock and heat generation at the center of the cathode 2, and also the returned back electrons that pass through the through hole 2*a* collide with the heat resistant member 9, heat generated due to back bombardment of the returned back electrons is diffused by the heat resistant member 9. Thus, even in an electronic gun being designed with a very high electron beam current density, damaging of the cathode 2 can be prevented and, moreover, a temperature increase or degradation of the heater 3 or the insulating material 8 can be reduced. As a result, a change in the property of the electron gun 1 can be prevented and an insulation failure can be prevented to allow a stable thermionic emission to be secured for a long time.

Here, in a case that heat generated due to back bombardment of the returned back electrons that return back to the electron gun 1 side is not negligible, the heat value of the heater 3 can be set lower in advance to suppress overheating of the cathode 2 due to a temperature rise of the heat resistant member 9. In other words, the electron gun 1 according to Embodiment 7 makes it possible to arrange the heat resistant member 9, between the cathode 2 and the heater 3, in the vicinity of the cathode 2 to improve the degree of freedom of design of the heater 3. In other words, while a related-art hollow cathode is influenced by back bombardment when the heating wire of the heater 3 or the insulating material 8 is arranged coaxially with the through hole 2*a* of the cathode 2, making the constraints with respect to the design of the electron gun strict, the electron gun 1 according to Embodiment 7 makes it easier to arrange the heater 3 and the insulating material 8 coaxially with the through hole 2*a* of the cathode 2.

Moreover, in a case that the heat resistant member 9 is formed so as to have the flat plate-like portion 91 and the projection 92 as shown in FIG. 17, the returned back electrons that reach the heating resistant member 9 through the through hole 2*a* of the cathode 2 collide with the projection 92 whose thickness of the heat resistant member 9 is increased, making it possible to sufficiently diffuse heat generated due to back bombardment of the returned back electrons and, as for the heat resistant member 9 located between the cathode 2 and the heater 3, the thickness thereof can be decreased as the flat plate-like portion 91 to satisfactorily secure a heating efficiency of the cathode 2 by heat (heat through the insulating material 8 or the sleeve 7) from the heater 3.

Embodiment 7 can be used in combination with any one of Embodiments 1 to 5, and/or Embodiment 6. For example, combining Embodiment 1 and Embodiment 7, upon the cathode 2 being provided with at least one of a cylindrical metal layer 11*a*, a annular metal layer 11*a*, or a metal tube 11*e* being fixed to a through hole via the metal layer 11*a* as a no-emitting layer 11, the cathode 2 can further be provided with the heat resistant member 9. Moreover, combining Embodiment 1, Embodiment 7, and Embodiment 6, upon the cathode 2 being provided with the heat resistant member 9 as well as at least one of the cylindrical metal layer 11*a*, the annular metal layer 11*a*, or the metal tube 11*e* being fixed to the through hole via the metal layer 11*a* as the no-emitting layer 11, the cathode 2 can be further provided with the grid 6.

While explanations have been given for Embodiments 1 to 7 of the present disclosure, the specific configuration is construed to be not limited to the Embodiments 1 to 7, so that any design changes in scope without departing from the gist of the present disclosure are included in the present disclosure. For example, while the heat resistant member 9 is installed to the cathode 2 via the flat plate-like portion 91 according to Embodiment 7, how the heat resistant member 9 is installed is not limited to a specific mode as long as it is arranged between the cathode 2 and the heater 3.

Embodiments 1 to 5 are configured to comprise the no-emitting layer at the opening edge on the electron emitting surface side of the through hole of the cathode or at the inner surface of the through hole thereof, causing an electron emission substance to be not present in the above-mentioned no-emitting layer, making it possible to suppress unintended emission of electrons from the through hole of the cathode. As a result, disturbance of electron beam forming and production of dark current can be prevented.

Moreover, the disclosure described in Embodiments 1 and 2 is configured to comprise a cylindrically-shaped metal layer or a metal layer in which a metal base body is melted and solidified, or a metal tube on the inner surface of the through hole thereof, and to comprise an annularly-shaped metal layer, or a metal layer in which the metal base body is melted and solidified in the opening edge on an electron emitting surface side of a through hole of a cathode, making it possible to provide filling of the inner peripheral surface or the opening edge of the through hole of the cathode, causing electron emission from inner and opening edge of the through hole of the cathode to be eliminated and causing electrons to be not present in a range in which the electric field is applied. Moreover, disturbance of electron beam forming production of dark current due to leakage current caused by unnecessary electrons can be prevented and electron beams with the electron trajectory as ideally designed can be secured.

EXPLANATIONS OF LETTERS

1 Electron gun
2 Cathode
2*a* Through hole
3 Heater
4 Anode
4*a* Opening
5 Wehnelt
6 Grid
6*a* Hole
7 Sleeve
8 Insulating material
9 Heat resistant member
91 Flat plate-like portion
92 Projection
93 Peripheral end
11 No-emitting layer
11*a* Metal layer
11*b* Metal layer in which metal base body is melted and solidified
11*c* Layer consisting of only porous metal base body
11*d* Layer in which pore of porous metal base body is impregnated with ceramic
11*e* Metal tube
22 C chamfer
23 R chamfer
101 Electron gun having related-art configuration
102 Cathode
103 Anode
104 Wehnelt
105 Heater
106 Grid
A Emission direction (traveling direction) of electrons

What is claimed is:

1. An electron gun comprising a cathode having an electron emitting surface and whose planar shape is circular, a heater, and an anode being arranged to oppose the cathode, wherein the cathode has a through hole along a central axis of the cathode at a central portion of the cathode; and the cathode has a no-emitting layer, wherein the no emitting layer is provided at an opening edge part of the through hole on the electron emitting surface side and/or at an inner surface of the through hole.

2. The electron gun according to claim 1, wherein the no-emitting layer is a metal layer.

3. The electron gun according to claim 2, wherein the metal layer is a layer of molybdenum, an alloy containing molybdenum, or a compound of molybdenum.

4. The electron gun according to claim 1, wherein the cathode comprises a metal base body and an electron emitting substance; and the no-emitting layer is a metal layer in which the metal base body is melted and solidified.

5. The electron gun according to claim 1, wherein the cathode comprises a porous metal base body and an electron emission substance with which a pore of the porous metal base body is impregnated; and the no-emitting layer is a layer consisting of only the porous metal base body.

6. The electron gun according to claim 1, wherein the cathode comprises a porous metal base body and an electron emission substance with which a pore of the porous metal base body is impregnated; and the no-emitting layer is a layer in which a pore of the porous metal base body is impregnated with ceramic.

7. The electron gun according to claim 1, wherein the no-emitting layer is a metal tube fixed to the through hole.

8. The electron gun according to claim 1, the electron gun comprising a grid between the cathode and the anode.

9. The electron gun according to claim 8, wherein the grid has a hole provided coaxially with the through hole of the cathode; and a diameter of the hole of the grid relative to a diameter of the through hole of the cathode is between 75 and 97%.

10. The electron gun according to claim 1, which further comprises a heat resistant member comprising a first portion to close the through hole of the cathode and a second portion being positioned between the cathode and the heater.

* * * * *